US010141170B2

(12) United States Patent
Gonin et al.

(10) Patent No.: US 10,141,170 B2
(45) Date of Patent: Nov. 27, 2018

(54) DEVICE FOR MASS SPECTROMETRY

(71) Applicant: TOFWERK AG, Thun (CH)

(72) Inventors: Marc Gonin, Thun (CH); Urs Rohner, Bern (CH); Christian Tanner, Olten (CH); Martin Tanner, Bern (CH); Joel Kimmel, Boulder, CO (US)

(73) Assignee: TOFWERK AG, Thun (CH)

( * ) Notice: Subject to any disclaimer, the term of this patent is extended or adjusted under 35 U.S.C. 154(b) by 11 days.

(21) Appl. No.: 15/317,531

(22) PCT Filed: Jul. 9, 2015

(86) PCT No.: PCT/CH2015/000101
§ 371 (c)(1),
(2) Date: Dec. 9, 2016

(87) PCT Pub. No.: WO2016/004542
PCT Pub. Date: Jan. 14, 2016

(65) Prior Publication Data

US 2017/0110305 A1 Apr. 20, 2017

(30) Foreign Application Priority Data

Jul. 9, 2014 (EP) ..... 14405055

(51) Int. Cl.
*H01J 49/00* (2006.01)
*H01J 49/40* (2006.01)

(52) U.S. Cl.
CPC ..... *H01J 49/0036* (2013.01); *H01J 49/40* (2013.01)

(58) Field of Classification Search
CPC .... H01J 49/0036; H01J 49/40; H01J 49/0031; H01J 49/0081; H01J 49/26
(Continued)

(56) References Cited

U.S. PATENT DOCUMENTS 5,995,989 A 11/1999 Gedcke et al.
6,707,411 B1 3/2004 Poulton et al.
(Continued)

FOREIGN PATENT DOCUMENTS

WO WO 2004/051850 A2 6/2004
WO WO 2006/124724 A2 11/2006
WO WO 2010/136765 A1 12/2010

OTHER PUBLICATIONS

DeCarlo et al., "Field-Deployable, High-Resolution, Time-of-Flight Aerosol Mass Spectrometer", Anal. Chem., Dec. 15, 2006, vol. 78, No. 24, pp. 8281-8289, total 14 pages.

*Primary Examiner* — Nicole Ippolito
(74) *Attorney, Agent, or Firm* — Birch, Stewart, Kolasch & Birch, LLP

(57) ABSTRACT

A device for mass spectrometry comprises an ionization source, a mass analyzer fluidly coupled to the ionization source and an electronic data acquisition system for processing signals provided by the mass analyzer. The electronic data acquisition system comprises at least one analog-to-digital converter (10) producing digitized data from the signals obtained from the mass analyzer and a fast processing unit (47) receiving the digitized data from said analog-to-digital converter (10). The fast processing (47) unit is programmed to continuously, in real time inspect the digitized data for events of interest measured by the mass spectrometer; and the electronic data acquisition system is programmed to forward (23) the digitized data representing mass spectra relating to events of interest for further analysis and to reject the digitized data representing mass spectra not relating to events of interest. The device allows for maintaining efficiency at high speed by eliminating all processing times (idle time in acquisition) for data segments that do not contain information about events.

15 Claims, 14 Drawing Sheets

(58) Field of Classification Search
USPC ..... 250/281, 282, 287
See application file for complete search history.

(56) References Cited

U.S. PATENT DOCUMENTS

2005/0270191 A1 12/2005 Hofstadler et al.
2012/0126110 A1* 5/2012 Green ..... G06K 9/0053
250/282

* cited by examiner

DEVICE FOR MASS SPECTROMETRY

TECHNICAL FIELD

The invention relates to a device for mass spectrometry comprising an ionization source, a mass analyzer fluidly coupled to the ionization source and an electronic data acquisition system for processing signals provided by the mass analyzer.

BACKGROUND ART

Mass Spectrometry

A mass spectrometer (MS) is a device for measuring the mass-to-charge ratio (m/Q) of ions. It can be used for chemical analysis. All types of MS operate by subjecting charged, gas-phase molecules or atoms (ions) to electric and/or magnetic fields within a reduced pressure (vacuum) environment.

Mass spectrometers are commonly used for chemical analysis of gaseous, liquid, solid and plasma samples in a broad range of disciplines.

Samples that do not originate in the gas phase must be converted to the gas phase (vaporization or desorption) before analysis.

Further, the molecules of the sample (analyte) must be given a charge (ionized) prior to analysis. Vaporization (if necessary) and ionization of the sample can take place in devices separate from the mass analyzer. Numerous techniques exist for vaporization and ionization of samples.

For a given sample, a MS generally records data for several chemical species corresponding to a broad range of m/Q. Data are often presented as "spectrum" of observed signal intensity as a function of m/Q, called a mass spectrum. In the digital age, this spectrum is represented by a histogram, e.g. series of digital values which closely represents the (continuous) spectrum.

The mass of an ion is a function of the specific atom(s) comprising the ion. For instance the most abundant water isotopologue cation, $H_2{}^{16}O^+$, has a mass of 18.01 Dalton (1 Da=m($^{12}$C)/12=1.66×10$^{-27}$ kg), which is the sum of the masses of 2 hydrogen atoms and 1 oxygen-16 atom minus one electron. With a net charge of 1 elementary charge e (e=atomic charge unit=1.602×10$^{-19}$ coulomb), this cation has m/Q=18.01 thomson (Th).

The mass spectrum of a sample can be used to deduce the identity of the molecules in the sample based on the observed m/Q value(s). For cases where the response of the MS can be appropriately calibrated, MS data can also quantify the concentration of specific molecules within the sample.

The disclosed invention relates to types of MS producing a large number of spectra in short time, in particular fast mass spectrometers providing 1'000 spectra per second or more. A prominent example is the time-of-flight mass spectrometer (TOFMS). This includes the recently proposed distance-of-flight mass spectrometers (DOFMS) or electrostatic ion traps. In the following, the invention is described in the context of a TOFMS.

A TOFMS includes a TOF analyzer (TOF 1) that determines the m/Q of an ion by measuring the time required for that ion to travel a known distance 2 after ions are accelerated to a known kinetic energy or by a known impulse 3, called an extraction. For any ion in a TOF the observed ion time-of-flight will be approximately proportional to the square root of the ion's m/Q. FIG. 1 shows a typical TOFMS.

Data Acquisition

The kHz extractions of the TOF mass spectrometer are generally triggered by an external timing generator 4.

The timing generator is an electronic device (stand-alone or PC component) capable producing high frequency triggers (digital outputs 5) with high temporal precision.

TOF extractions may run continuously and freely or they may be configured to occur simultaneous to some external process 6, such as the changing of a sample or a pulsed ionization event. To achieve such synchronization, the timing generator may also receive external triggers (inputs 7) and can be programmed to output triggers 5 relative to these input triggers.

TOF mass spectrometers typically detect the presence of ions using microchannel plate (MCP) detectors 8. When struck by an ion these detectors output a detectable voltage 9. The flight time of an ion is the time between the extraction event and the moment that ion strikes the MCP.

In order to measure the flight times of ions with high precision, TOF mass spectrometers typically use time-to-digital or analog-to-digital converters (TDC and ADC, respectively) with GHz or faster sampling rates (nanosecond of sub-nanosecond precision). These digitizers 10 convert the voltage output by the MCP to a digital value 11 that can be saved in a computer 12.

As an example, U.S. Pat. No. 6,707,411 B1 (Agilent) discloses an ADC with on-chip memory. The ADC is structured to generate digital samples at a sampling rate. At least one of a data output of the memory, a data output bus and an output port is structured to operate at a maximum rate less than the sampling rate. The ADC may include a sample processor to reduce the rate at which received digital samples are conveyed to the memory, furthermore, the samples may be read out from the memory at a rate less than the sampling rate.

Accurate recording of an ion's flight time requires synchronization of the digitizer 10 with the TOF extraction events. This synchronization is generally managed by the timing generator, which outputs a simultaneous trigger at output 5 to the digitizer and the TOF. In some cases, the timing generator is a component of the digitizer.

In most configurations, the digitizer records a continuous stream of values beginning at the moment of the extraction and extending for some period less than or equal to the TOF extraction period. This waveform represents the mass spectrum of the sample entering the mass spectrometer during that extraction. Graphically, it is typically presented as a histogram of values (intensity vs time of flight) 16. For the purposes of the data acquisition (DAQ), the waveform is best thought of as a 1-dimensional array 17 (see FIG. 2).

TOF analyzers potentially produce a complete spectrum for every TOF extraction. A typical TOF extraction rate is 10 to 200 kHz. This means TOFMS are capable of recording fast processes down to a 5 μs time scale. Such fast monitoring produces a large amount of data which may be too large for PC based data acquisition.

Processes that are slower than the TOF extraction rate can be observed by accumulating (or averaging) many consecutive TOF extractions in a segment 18 of the memory 19 of the digitizer 10 (see FIG. 3).

This so called waveform averaging 20 (see FIG. 4) reduces the total amount of data. For example a process can be monitored with a 1–s time resolution, thereby allowing the waveforms of 50'000 TOF extractions to be averaged into a single summed spectrum. This reduces the data load for at least a factor of 10'000.

For the TOF to resolve (observe) changes in chemical composition, the DAQ system must record and save data at a rate (average spectra/sec) equal to or greater than the changes of interest.

In theory, the maximum continuous save rate (MCSR) is equal to the TOF extraction frequency. In this case, no averaging would be employed, and the data corresponding to each TOF extraction would be saved.

In practice, the MCSR is determined by technical specifications of the DAQ hardware.

In the most efficient DAQ systems, waveform averaging is performed in the memory of the digitizer (see FIG. 5). After the defined number of TOF extractions have been waveform averaged in memory, the averaged waveform 21 is transferred 22 from the digitizer memory 19 to PC RAM 13 and eventually saved (step 23) to the hard disk 14 (cf. FIG. 1). We refer to this transfer and save as the processing step 24.

Because acquisition may be idle during some or all of the transfer step, the achieved continuous save rate, which is the inverse of the time 25 between successive save events, is affected by the rates at which each average spectrum can be transferred to the PC and saved to disk (cf. FIG. 6).

The significance of the time required to write data to the hard drive depends on the architecture of the data acquisition software (e.g., employment of multiple threads); for most modern applications it only needs to be considered at extremely high save rates.

For simplicity, we consider the case of a digitizer with a single memory buffer, such that acquisition is completely idle during the transfer step. And we introduce the term idle time to describe the duration of the transfer step and any other time latencies associated with the processing of each averaged dataset.

In this case, the continuous save time 25 is the sum of the averaging time 26 and the idle time 27. And the save efficiency, which is the fraction of the continuously running TOF extractions that are saved, is the ratio of the averaging time 26 to the continuous save time 25.

In the most efficient scenarios (acquisition regime 28) the idle time is negligible compared to the averaging time. Here, save rates (average mass spectra/sec) can be increased by reducing averaging time with little cost to efficiency.

As save rates are increased, a low efficiency regime (acquisition regime 29) is reached, where averaging times are short relative to idle times. In this regime, decreases in averaging time reduce efficiency linearly, but have little effect on save rates. Save rates (average mass spectra/sec) effectively plateau at the inverse of the idle time.

This point at which the acquisition rate plateaus is the maximum continuous save rate (MCSR). For instance, if transfer of data requires 500 microseconds and the digitizer is idle during this time, the MCSR is 1/500 microseconds=2000 kHz.

The MCSR of an analog-to-digital converter (ADC)—based system is often slower than the TOF extraction frequency, whereas time-to-digital converters (TDC)—based systems have MCSR approaching or equal to the TOF extraction frequency. This difference is related to the larger size (bytes) of data points recorded by the ADC and the longer time required for transfer and save of these larger values.

Continuous Samples

Some MS experiments make a single measurement of a single sample, in order to determine its instantaneous chemical composition. In these cases, data acquisition rates are irrelevant. The experimenter can average data for any duration less than or equal to the amount of time the steady-state sample produces ions.

Other MS experiments make successive, time-resolved measurements of a single sample, in order to monitor how the composition of that sample changes in time. An example of this is the measurement of the concentrations of gases in ambient air. Changes of interest may vary on timescales ranging from 1 microsecond to longer.

MS spectra should be saved at a rate greater than or equal to the rate of changes interest. Below this rate, dynamic changes in ion intensities will be averaged and not resolved. For example, see FIG. 7 which shows measurements (recorded signals 31, 32) of a continuous ion intensity signal 30 at two different save rates, corresponding to segments 20 of different lengths.

For experiments recording successive spectra to monitor changes in a single sample, the save efficiency is approximately 100% for data acquisition with waveform averaging at rates less than or equal to MCSR.

Observations of phenomena changing at rates faster than the MCSR cannot be made continuously. Instead, they can only be made in discontinuous bursts (Methods for accomplishing this are described later in the next section).

Discontinuous Samples

Other MS experiments make successive measurements of different samples, in order to compare the composition of the different samples. Some finite time exists between the measurements of successive samples.

The changing of the sample may be controlled by the experimenter. An example is the movement of a pulsed ionization laser across a surface in order to compare composition at different positions.

Alternatively, the changing of the sample may be driven by some sporadic external phenomena. An example is the measurement of the mass spectra of individual ambient aerosol particles, where particles are sampled from the air into the mass spectrometer.

In some cases, the experiment aims only to measure the steady-state chemical composition of each sample. In this case a single average mass spectrum is recorded for each sample.

In this steady-state case, the required rate of data acquisition depends on how rapidly the sample is changing, i.e., how much time exists between successive samples.

Data may be acquired continuously with waveform averaging across the duration of the entire sequence of samples, provided the waveform averaging can be done at a rate faster than the changing of the samples. i. e., provided the sample is changing at a rate below the MCSR. See, for example, FIG. 8 which shows the resolution of three discrete samples (ion intensities 33) resolved with continuous waveform averaging yielding the recorded signal 34. The samples are able to be resolved because they enter the mass spectrometer at a rate well below the averaging rate.

Alternatively, acquisition of a single average spectrum may be synchronized with the production/ionization of each sample.

For cases where the experimenter controls the changing of the sample, this synchronization is relatively straightforward. For instance, a single average spectrum may be acquired following each firing of an ionization laser. Such acquisition is shown in FIG. 9. The external triggers 35 relating to the ionization impulses are input to the digitizer in order to synchronize discontinuous waveform averaging. The triggers may be periodic, however this is not compulsory. The discontinuous ion signal 36 is correlated with the triggers 35, the averaging into segments 20 is shown in time line 37, yielding signal 38.

For cases where the changing of the sample is sporadic, synchronization requires some external measurement to determine the presence of a sample. For instance, for ambient aerosol particles being sampled into a mass spectrometer, one may detect the presence of a particle in the inlet of the mass spectrometer via a light scattering measurement. Acquisition of the mass spectrum is then triggered when light scattering signal is detected. Many single particle mass spectrometers operate on this principal.

An alternative has been proposed in P. F. DeCarlo, "Field-Deployable, High-Resolution, Time-of-Flight Aerosol Mass Spectrometer" (Anal. Chem., Vol. 78, No. 24, December 2006, 8281), namely a so-called "brute-force single-particle (BFSP) mode". According to that proposal, a single chopper cycle obtained prior to ionization is captured and transferred without prior averaging to computer memory. After transfer to memory, the data is filtered with user-defined, single-particle signal thresholds on multiple values of m/Q or combinations of values of m/Q, allowing the identification of single particle events and recording full mass spectra of these events. However, due to the high overhead for transferring large amounts of data from the ADC to the computer memory through a PCI bus, the duty cycle was very low. A slight improvement of the duty cycle was achieved by on-board data compression.

In other cases, the experiment aims to measure time-varying changes in the composition of each sample. In this case, multiple successive mass spectra are recorded for each sample.

For cases where the time-varying changes of interest in each sample are slower than the MCSR, it is possible to acquire data continuously in waveform averaging mode across the duration of the entire sequence of samples.

Alternatively, a second, discontinuous averaging mode exists that enables short bursts of acquisition at rates greater than the MCSR. For example, a quick succession of mass spectra could be collected following each pulse of the ionization laser.

In this block averaging mode, which is detailed in FIG. 10, the memory buffer 19 of the digitizer is configured to have multiple segments 18 (in contrast to the single segment used in waveform averaging).

For instance, a process of interest with total duration of 1 ms can be recorded into a 20-segment block, where 20 successive TOF extractions of 50 us each are written into the 20 unique segments without averaging. Following acquisition of this block, the system goes idle while the data block is processed (see FIG. 11), i. e. during the processing step 24 including the transfer 22 of the data in the digitizer memory 19 to RAM 13 as well as saving 23 the data to the computer hard drive 14. The advantage here is that there is no dead-time for transfer between the acquisitions of each extraction. Instead, the dead time occurs after the acquisition of the extractions of interest. This enables the recording of a burst of successive TOF spectra with an effective save rate greater than the MCSR.

FIG. 12 demonstrates the application of block averaging to the laser ionization example of FIG. 9. Note that with block averaging 40 yielding corresponding segments 39, the decay of signal for each sample is resolved as can be seen from the recorded signal 41.

With block averaging 39, it is also possible to average successive waveforms in a single segment. This is detailed in FIG. 13. For example, the 1 ms event just described could also be recorded in a 10-segment block where 20 successive TOF extractions of 50 us each are written into the segments by averaging 2 waveforms per segment (e.g., segment 1 is the average of waveforms 1 and 2).

Note that waveform averaging is equivalent to block averaging with one segment per block.

For experiments making measurements of many samples, one may maintain 100% acquisition efficiency by synchronizing the sample change with the data acquisition blocks. Using the example from above: The pulsing of the ionization laser being used to compare different positions on the surface would be synchronized with the start of data acquisition blocks.

For experiments making measurements of many samples, where the experimenter does not control the changing of the sample, the experimenter has three choices:

(i) Continuously acquire waveform average data below the MCSR, thereby maintaining high acquisition efficiency. As shown in FIG. 8, this method succeeds if the changes of interest (sample change or change in single sample) are slower than MCSR. Using the example from above: Individual ambient aerosols are being sampled into the mass spectrometer at a rate (particles/s) lower than the MCSR. FIG. 14 shows the case where the rate of sample occurrence 42 is much higher than the acquisition rate (time line 43). As can be seen from the recorded signal 44, ions from all/most samples are measured, but the individual samples are not resolved.

(ii) Continuously block average data or waveform average at a rate above the MCSR. This method allows the resolution of more rapidly changing samples, but risks missing many samples, an effect that increases with increased acquisition rate. Using the example from above: Individual ambient aerosols being sampled into the mass spectrometer (particles/s) are only measured if they are sampled during an acquisition event; they are missed if they are sampled during a process event. This is demonstrated in FIG. 15, where the samples 42 from FIG. 14 are measured with block averaging (time line 45). As can be seen from the recorded signal 46, individual samples are resolved, buy many are missed because of the significant idle times.

(iii) Acquire data in the block mode, where each data acquisition block is triggered by some external measurement that detects the presence of a sample. Extending the example from above: An individual ambient aerosol particle is detected by a non-destructive optical measurement technique upstream of the mass spectrometer, thereby triggering the start of a mass spectrometer data acquisition block. This method requires that the samples of interest are detectable by a non-destructive method that is compatible with the MS sampling system. Efficiency is derived from the fact that time is not wasted processing mass spectra that do not contain information of interest. The extent of this efficiency gain depends on the rate at which samples enter the mass spectrometer. At low rates, efficiency can approach 100%. At high rates, where all spectra have information of interest, there is no gain.

It is apparent that each of the three approaches has its downsides and that there are situations where the quality of the obtained measurements is compromised in all the three cases.

SUMMARY OF THE INVENTION

Accordingly, it is the object of the invention to create a device for mass spectrometry pertaining to the technical field initially mentioned, that allows for making high frequency measurements of many samples with high efficiency.

The solution of the invention is specified by the features of claim 1. According to the invention, the electronic data acquisition system comprises at least one analog-to-digital converter (ADC) producing digitized data from the signals obtained from the mass analyzer; and a fast processing unit receiving the digitized data from said analog-to-digital converter.

The fast processing unit is programmed to continuously, in real time inspect the digitized data for events of interest measured by the mass spectrometer. The electronic data acquisition system is programmed to forward the digitized data representing mass spectra relating to events of interest for further analysis and to reject the digitized data representing mass spectra not relating to events of interest.

In particular, the digitized data is constituted by (or comprises) mass spectra, for simplicity, in the following this term is used for spectra of values of m/Q (mass/charge). The fast processing unit may comprise in particular a digital signal processor (DSP), most preferably a Field Programmable Gate Array (FPGA).

Continuous, real-time processing means that essentially all incoming data obtained from the ADC may be readily inspected for events of interest prior to deciding about forwarding or rejecting the data, the time used for inspection of a certain portion of data being equal or less than the time used for obtaining the signals represented by the data portion by the mass analyzer. Simultaneous to the continuous acquisition of TOF extractions, the fast processing unit is used for real-time analysis of the data to identify regions within the continuous stream of TOF extractions that contain events of interest (see FIG. 16).

We refer to those instances when a sample of interest is present as events or events of interest. We refer to the inventive method as "event triggering".

Rejection of digitized data not relating to events of interest means that this data is not forwarded to the usual further analysis. It may be completely discarded, or processed in a way that does not use a substantial capacity of the communication channel linking the electronic data acquisition system to the hardware performing the further analysis. A corresponding processing may include heavy data compression, in particular lossy compression as achieved by further processing, especially on-board at the fast processing unit.

As described earlier, the maximum continuous save rate (MCSR) of existing technologies is limited by overhead processes. Without averaging, the data rate for rapidly occurring events increase to a level that is too large to handle for today's data systems, whose bottle necks are given in particular by the download speed from the DAQ to the PC, the processing of the data in the PC, or the writing of the data to the mass storage device. The MCSR, in turn, limits the maximum rate at which events can occur and still be individually saved with high efficiency.

The disclosed invention circumvents these overhead bottlenecks by transferring and saving only select TOF extractions that correspond to events of interest (EOIs). That is, TOF data are continuously acquired but not all data are transferred and saved.

The proposed device allows for maintaining efficiency at high speed by eliminating all processing times (idle time in acquisition) for data segments that do not contain information about events. By reducing dead times, reducing PC data load, and increasing the fraction of events that may be recorded at high rates, the device allows for improving TOF performance for experiments targeting both steady-state and time-varying characterization of samples.

In particular, the data acquisition according to the invention enables highly efficient data acquisition at rates faster than the MCSR for experiments measuring multiple successive samples (discontinuous), i. e. cases where the signal of interest is oscillating between ON states (sample present) and OFF states (time between sample). It basically allows for measuring the complete chemical composition of many events in rapid succession with a TOFMS.

Such rapidly changing events can occur when the ionization method coupled to the mass spectrometer is not continuous but transient or sporadic. For example a pulsed laser produces a short burst of ions, also called an event. A pulsed discharge may produce a transient signal event. A flash light source can produce an event.

Such rapidly changing events can also occur when samples are introduced into the mass spectrometer in a transient or sporadic manner. It may be the case that a discontinuous sample is introduced into a continuous ionization source producing bursts of signal of interest, also called events. It may also be the case that a discontinuous sample is introduced into a pulsed ionization source, producing events.

Furthermore, the invention is particularly preferable in systems for measuring successive samples that are introduced to the mass spectrometer in a rapid and non-periodic or non-predictable manner, i. e. occurrences of successive events are not strictly periodic in time and external triggering of the TOF is not possible and/or practical. In these and other cases, averaging of data may be difficult and/or lack meaning. A highly relevant example of non-periodical, inhomogeneous events is the measurement of the chemical composition of individual small particles, for example nano particles, aerosol particles, cells or other biological entities, clusters and other entities with a dimension falling in the range of 1 nm or larger. In such cases, particles are rapidly sampled into the mass spectrometer in a sporadic succession.

A further scope of application are methods where successive events have inhomogeneous chemical composition.

However, the method can also be used for measurements of slowly changing samples and samples that are changing in a predicable manner.

Finally, compared to methods that use external measurements to indicate events, such as the common implementations of single particle mass spectrometers, the invention is advantageous because it does not require additional chemical or physical analysis hardware, and all of the complication associated with such hardware.

Preferably, the analog-to-digital converter comprises a buffer memory for storing a number of data segments, each segment representing a mass spectrum, wherein data segments representing mass spectra relating to events of interest are forwarded for further analysis and data segments representing mass spectra not relating to events of interest are rejetted.

In a preferred embodiment, the analog-to-digital converter is programmed to average the digitized data representing a plurality of mass spectra and to store the resulting averaged data in the buffer memory.

Like waveform averaging, the method continuously acquires waveforms with user-defined averaging (number of extractions per segment). But, it allows the user to download only those segments that include data of interest and to exclude any segments that do not contain data of interest.

There may be reasons why the data relating to a plurality of mass spectra should not be averaged. For example, the mentioned particles may stem from different populations and averaging of random particles may not be meaningful. Or it may be the purpose of an experiment to find the difference between single particles. In such cases, the data from single events cannot be averaged and need to be recorded individually.

Said digitized data is grouped in segments, where each segment represents at least one individual extraction of said mass analyzer, and thus at least one, preferably several consecutive waveforms constitute the digitized data of a segment, relating to an event.

Alternatively, the grouping may be different and an event may include only parts of waveforms or waveforms that are not consecutive.

Preferably, said inspection is based on a filter definition, the filter definition comprising at least one region of interest (ROI) including a selection of values of m/Q and further comprising at least one filter criterion to be applied to the at least one region of interest.

If there is a plurality of regions of interest they may be overlapping or non-overlapping. They do not need to cover the entire mass spectrum. Generally, the values of m/Q included in the selection relate to expected peaks, i. e. m/Q values of ions obtained from expected constituents of the analyzed sample. It is also possible to define ROIs that comprise only a fraction of a peak, e. g. in cases of heavily occupied nominal masses. The selection may include neighbouring as well as distanced values. A variety of filter criteria may be employed. An event may be detected if a certain filter criterion is met or if a certain filter criterion is not met. An example of filter criteria are threshold values. The thresholds may be fixed or depend from characteristics of the measured spectrum or spectra.

Advantageously, the selection of values of m/Q is a subsection of all values of m/Q of an entire mass spectrum. Consequently, at least one value of m/Q values of the entire mass spectrum is excluded from the selection of values of m/Q. The selection may include values lying next to each other or distanced values. That means the selection may for example include low m/Q values and high m/Q values without the middle part of the mass spectrum.

Information gained in the filtering step can also be used to guide averaging in the ADC memory or in a further stage. For instance, data of all elected events can be averaged.

Regions of interest and criteria may be associated to each other in different ways.

Firstly, the filter definition comprises a plurality of regions of interest and an event of interest is identified by application of the at least one filter criterion to the plurality of regions of interest, results of the application to different regions of interest being logically combined.

This means that the logical (e. g. boolean) results of the application of the at least one criterion to the different ROIs are combined by logical operators (such as AND, OR, XOR, NOT etc.).

Secondly, the filter definition comprises a plurality of filter criteria and an event of interest is identified by application of the plurality of filter criteria to the at least one region of interest, results of the application of different filter criteria being logically combined. This time, the logical (e. g. boolean) results of the application of the different filter criteria to the at least one ROI are combined by logical operators.

Both approaches may be combined. This means that a single or a set of criteria are assigned to each region of interest and the different results of the application of the criteria originating from different types of criteria as well as different ROIs are finally combined by logical operators.

Filters vary in complexity and may target a single type of event or multiple types of events. For instance, in the example of the aerosol spectrometer, a filter might be defined in order to identify aerosols that contain a specific set of ions (single event type) or one of many sets of ions (multiple types of events).

All filter definitions are based on regions of interest (ROIs 49). An ROI is a set of data points within the continuous data array corresponding to a TOF segment (single waveform or averaged waveforms).

Because the TOF spectrum is equivalent to a mass spectrum, this set of data points represents a set of mass/charge (m/Q) values. An ROI may be a continuous or a discontinuous set of m/Q values. See FIG. 17 for examples of ROIs.

For each ROI 49, the experimenter also defines some logical criterion 50 or criteria to be applied to the set of data points.

The scope of potential ROI criteria is enormous. In the most common implementations, the criterion is comparison of the total signal within an ROI to a threshold signal level.

For each recorded TOF spectrum (segment), the fast processing unit then determines whether an ROI is true (criteria 50 met) or false (criteria 50 not met). This is referred to as the ROI result 51.

The user may logically combine the return values of multiple ROIs to define a filter. This allows the user to define more sophisticated EOIs. Ultimately, for each segment, the FPGA tests all ROI criteria, combines ROI criteria results as defined by the filter 52, and assigns a positive (EOI exists in segment) or negative (event does not exist) EOI result 53 to the segment 21.

In the most common embodiment, positive data segments are transferred from the DAQ to PC RAM and saved to a permanent storage drive, whereas these steps are not carried out for negative data segments.

In a preferred embodiment, said processing unit computes for each of said at least one region of interest at least one value that correlates to or encodes a total ion signal in said region. Correspondingly, a filter criterion may be the meeting of a threshold of the total ion signal in a certain region, especially in a region that relates to m/Q values of an expected species of ions.

Preferably, the device further comprises an averaging module for receiving the mass spectra relating to events of interest and for averaging the received mass spectra prior to further analysis.

This means that event triggering is employed before signal averaging or in between a first and a second averaging step. This is beneficial e. g. in cases where the experimenter is interested in the average profile of a discontinuous sample or discontinuous sample population. In this case, achieved signal-to-noise ratios in averaged data can be enhanced by rejecting those portions of the data stream that contain only noise (no events).

In particular, waveforms are averaged in segments ("waveform averaging") before event trigger filtering is applied and then those segments containing events are averaged in a second averaging step. It is preferable that in order to perform this second averaging, the ADC has a second memory buffer, different than that used for averaging waveforms in segments.

In particular, the averaging is done in such a way that all the segments that belong to a single event are averaged, such that a single averaged segment is saved per event.

Furthermore, it is possible to apply the averaging step in order to average all the segments relating to events of the same kind (same "finger print").

This (second) averaging step is optional. In some applications, further averaging after event triggering is not required.

The fast processing unit can be also used for additional processing of positive or negative segments 55, in order to take advantage of the superior processing speed compared to the PC and/or to minimize the total amount of data transferred from the ADC to the PC.

Preferably, the device further comprises a classifier module for classifying identified events according to classification criteria, wherein results obtained from classification are transferable along with the digitized data representing the mass spectra relating to events of interest for further processing.

The classifier module may be realized by software running e. g. on the fast processing unit. In particular, classification allows for the using of different filter criteria and distinguishing between mass spectra elected due to different criteria. Nevertheless, the classification criteria do not need to form a subset of the filter criteria or the other way round. Accordingly, it is possible to provide the results of the classification relating to mass spectra that are not elected by applying the filter criteria.

The transfer of the results may speed up the further processing of the data. Information gained in the classification step can also be used to guide averaging in the ADC memory or in a further stage. For instance, data of all events or events in the same classification can be averaged.

Preferably, the device further comprises a counting module for counting a number of events in each of a plurality of classes, wherein results obtained from counting are transferable along with the digitized data representing the mass spectra relating to events of interest for further processing. These results may also be transferred with respect to mass spectra that do not relate to events of interest elected by application of the filter criteria.

For instance, a user might choose to transfer MS data for only some classifications of EOIs or not transfer any MS data at all, but still maintain knowledge of the total number of EOIs observed in each class.

Preferably, the electronic data acquisition system comprises an interface for receiving external data, and the electronic data acquisition system is programmed to forward the received external data relating to an event of interest together with the digitized data representing mass spectra relating to the event of interest and/or to include the received external data in the inspection of the digitized data for events of interest.

In a preferred embodiment, the electronic data acquisition system is programmed to forward digitized data representing a user-defined portion of the mass spectra relating to events of interest for further analysis. This allows for reducing the data to be transferred, accordingly, the efficiency is further enhanced. The portion may be connected or disconnected. Its form may also depend on filter and/or classification criteria.

After determination of EOIs or classification based on the entire mass spectrum, the user may choose to transfer and save only specific data points within mass spectrum. For instance, an experiment to probe lead content of aerosol particles may define an EOI(s) that identifies all particles, and then transfer and save only the data points corresponding to $^{204}Pb^{+}$ for each particle.

Preferably, the electronic data acquisition system comprises a first unit comprising the fast computing unit and being unitary with the mass analyzer and the device further comprises an external computing unit for further analysis, wherein only the digitized data representing mass spectra relating to events of interest is forwarded from the first unit to the external computing unit.

It is common that the data representing the mass spectra analyzed at the mass spectrometer and being preprocessed, in particular digitized, is sent to a PC for the final analysis by the user. Having a device with the inventive data acquisition system including the ADC and the fast processing unit allows for essentially transferring the entire data relating to events of interest to the PC by usual data connections, without having to provide huge buffer memories or bearing long delays.

In a further preferred embodiment, the device further comprises a controller for controlling the operation of the ionization source and of the mass analyzer, wherein the controller receives data obtained from the inspection of the digitized data for events of interest and wherein the controller adjusts operation parameters of the ionization source or of the mass analyzer or of both the ionization source and the mass analyzer based on the received data. This allows for real time optimization of the measurements, e. g. in order to improve the detection limit and the signal-to-noise ratio.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

Preferred Embodiments

Figure 1:
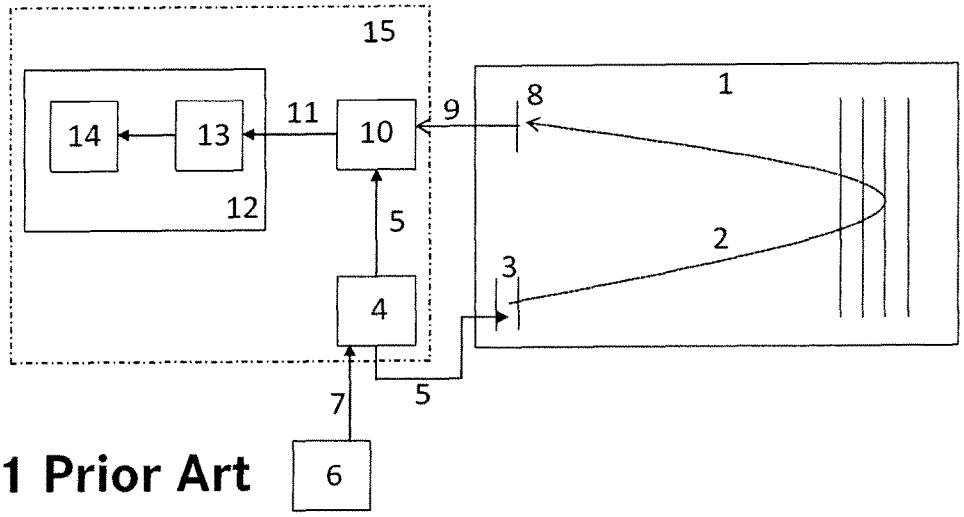
Fig. 1 Prior Art
FIG. 1 A TOF analyzer with a data acquisition system (DAQ)
Figure 2:
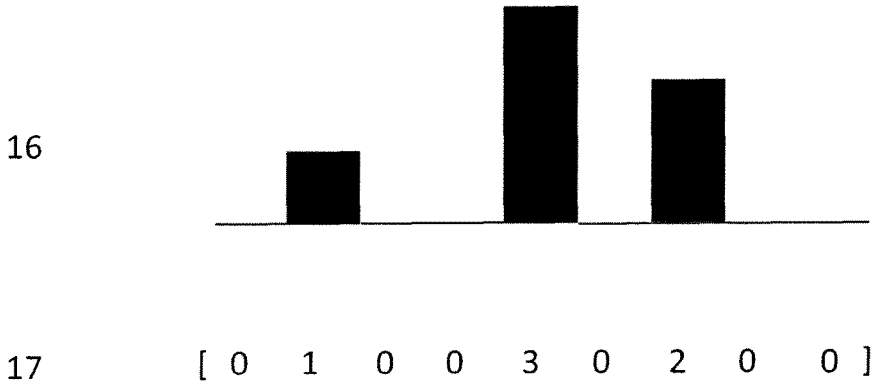
Fig. 2 Prior Art
FIG. 2 graphical and array representations of a TOF waveform.
Figure 3:
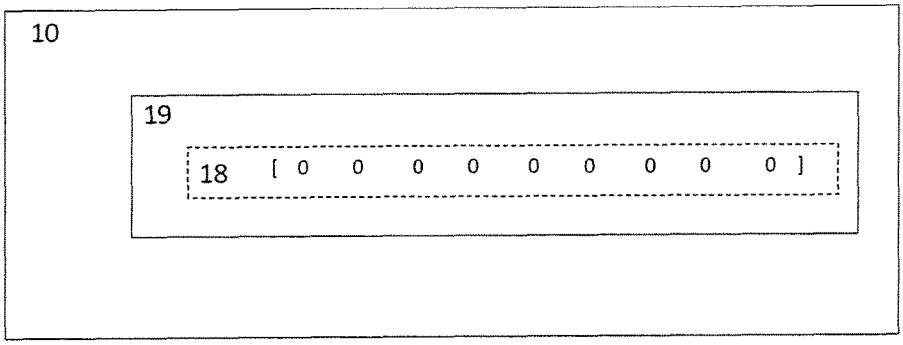
Fig. 3 Prior Art
FIG. 3 the configuration of a digitizer memory for waveform averaging with a single segment.
Figure 4:
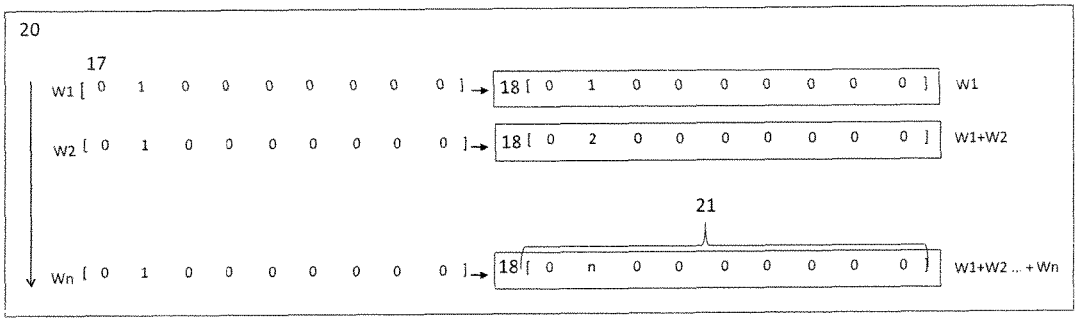
Fig. 4 Prior Art
FIG. 4 waveform averaging, n successive waveforms (W1, W2, . . . Wn) are summed in a single memory segment to produce an averaged waveform.
Figure 5:
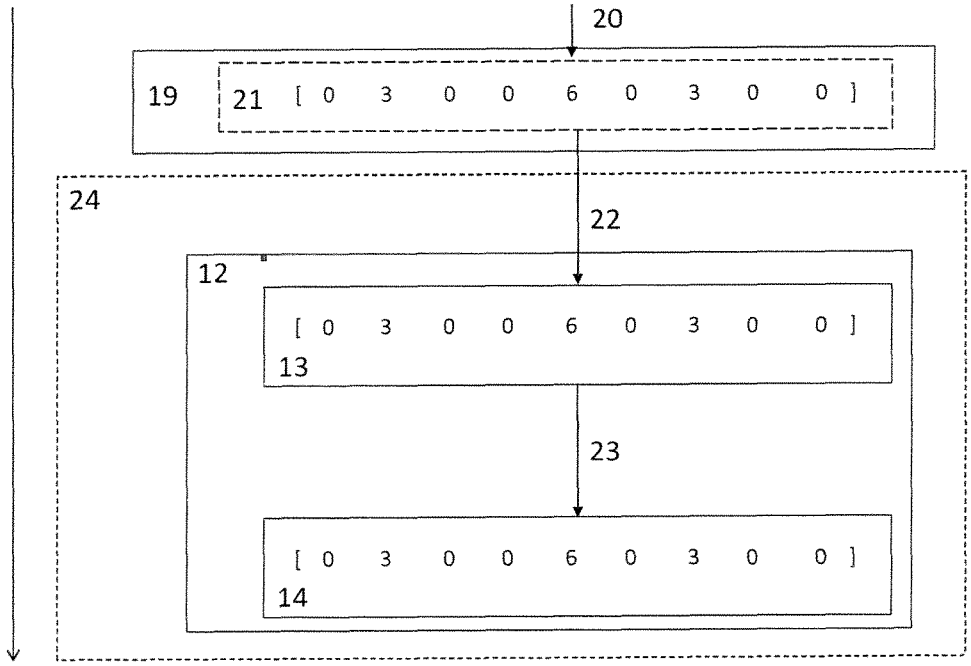
Fig. 5 Prior Art
FIG. 5 data acquisition steps, waveforms are averaged in a segment of the digitizer memory, transferred to PC RAM, and then saved to disk.
Figure 6:
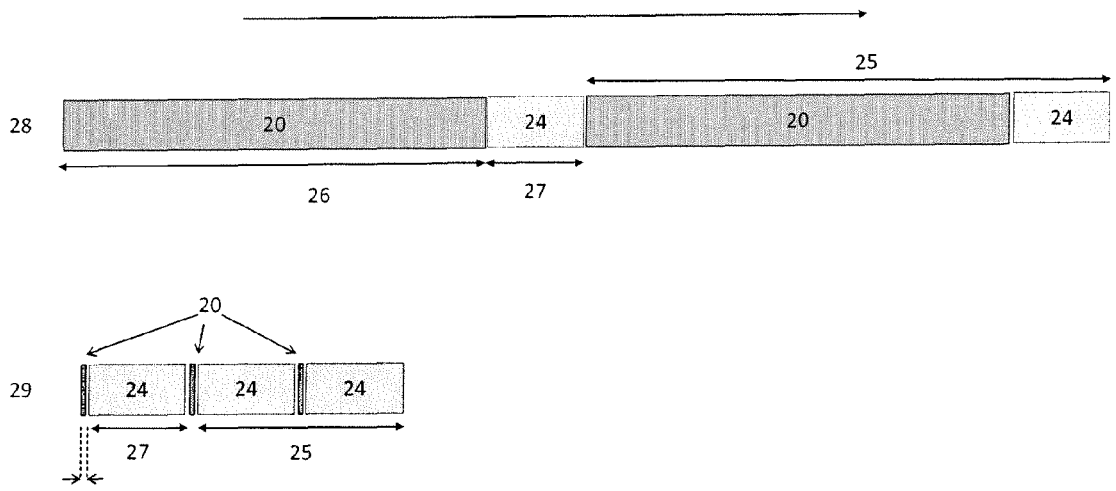
Fig. 6 Prior Art
FIG. 6 a graphical depiction of data acquisition for long and short averaging time, when the averaging time is long relative the to idle time, acquisition is highly efficient and decreases in averaging time increase the save rate, when the averaging time is short relative to the idle time, save rates plateaus at the maximum continuous save rate (MCSR)
Figure 7:
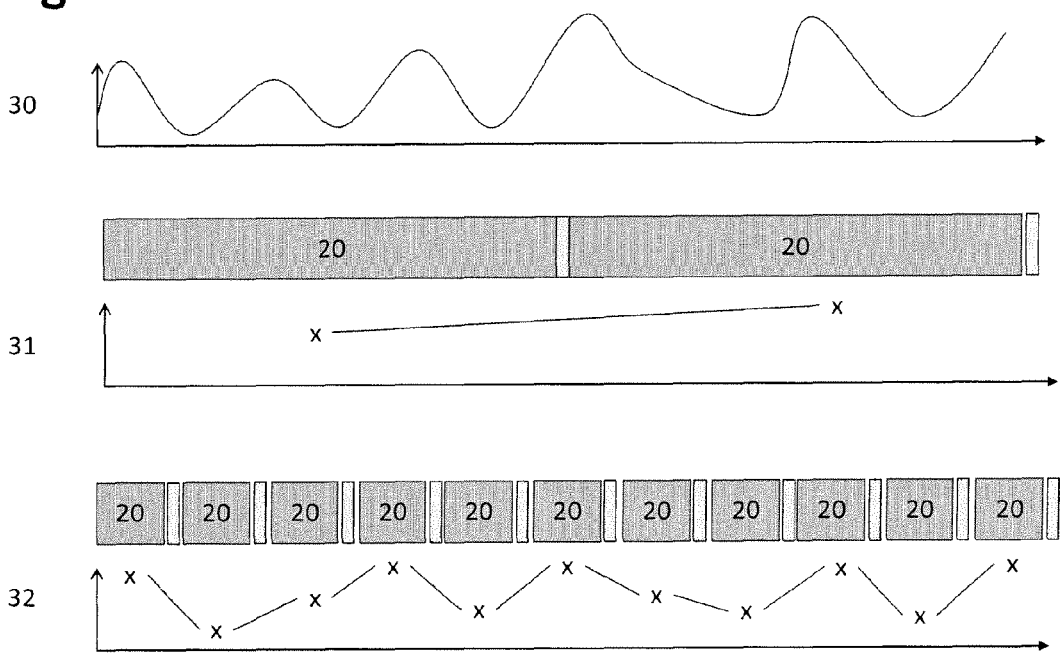
Fig. 7 Prior Art
FIG. 7 the resolution of changes in sample as a function of the continuous save rate.
Figure 8:
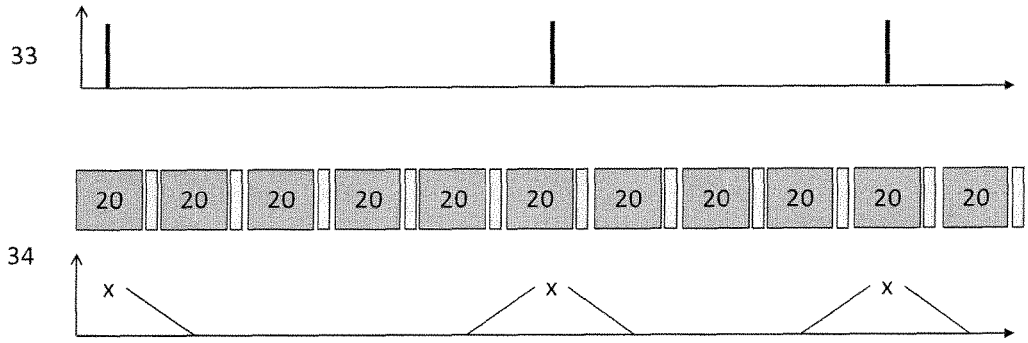
Fig. 8 Prior Art
FIG. 8 the resolution of individual events with a low rate of occurrence, continuous acquisition using waveform averaging below the MCSR; the samples are able to be resolved because they enter the mass spectrometer at a rate well below the averaging rate.
Figure 9:
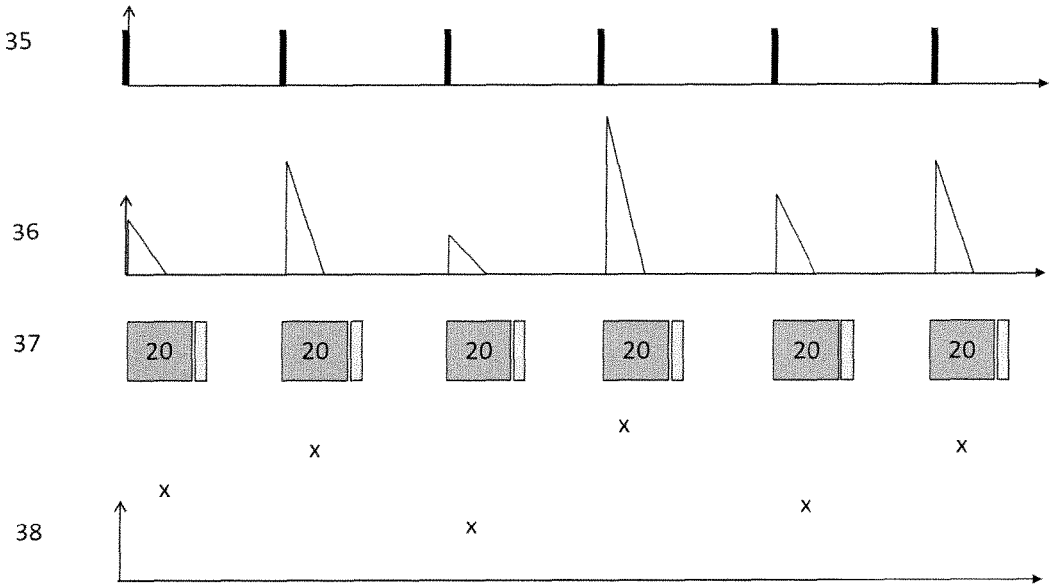
Fig. 9 Prior Art
FIG. 9 discontinuous waveform averaging with synchronization of DAQ acquisition to an external trigger, e.g. an ionization laser that is synchronized with the periodic changing of sample.
Figure 10:
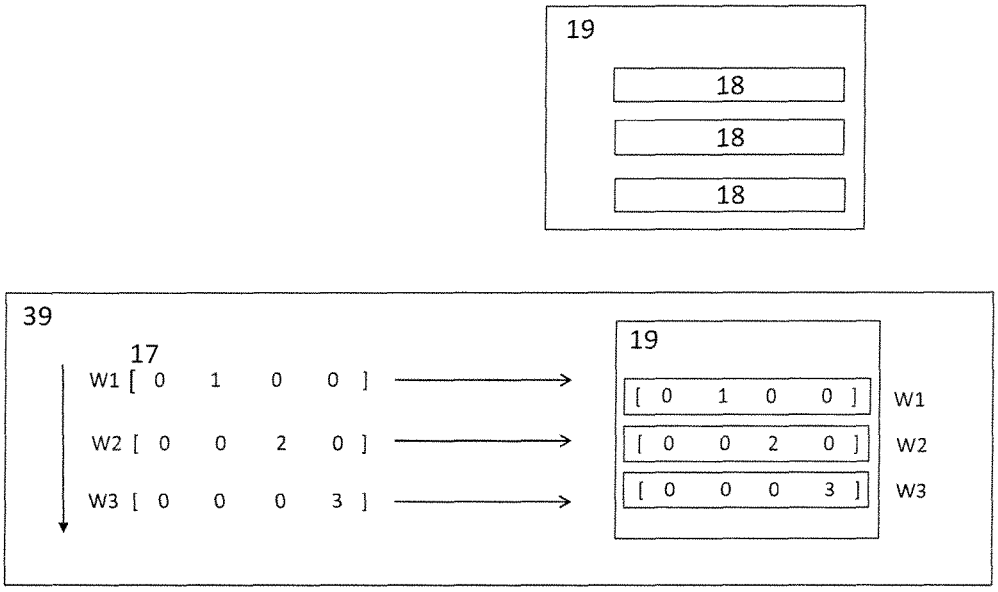
Fig. 10 Prior Art
FIG. 10 block averaging, depicted for a situation where the digitizer memory has been configured to have 3 memory segments.
Figure 11:
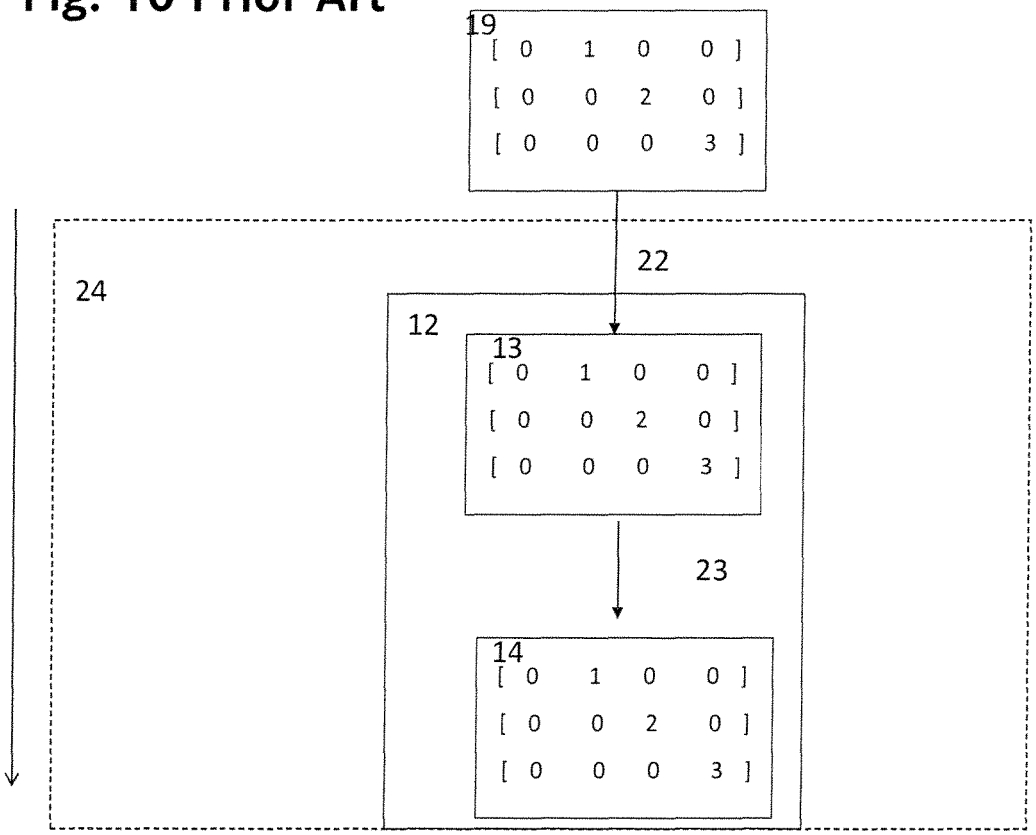
Fig. 11 Prior Art
FIG. 11 data acquisition steps for the block averaging mode.
Figure 12:
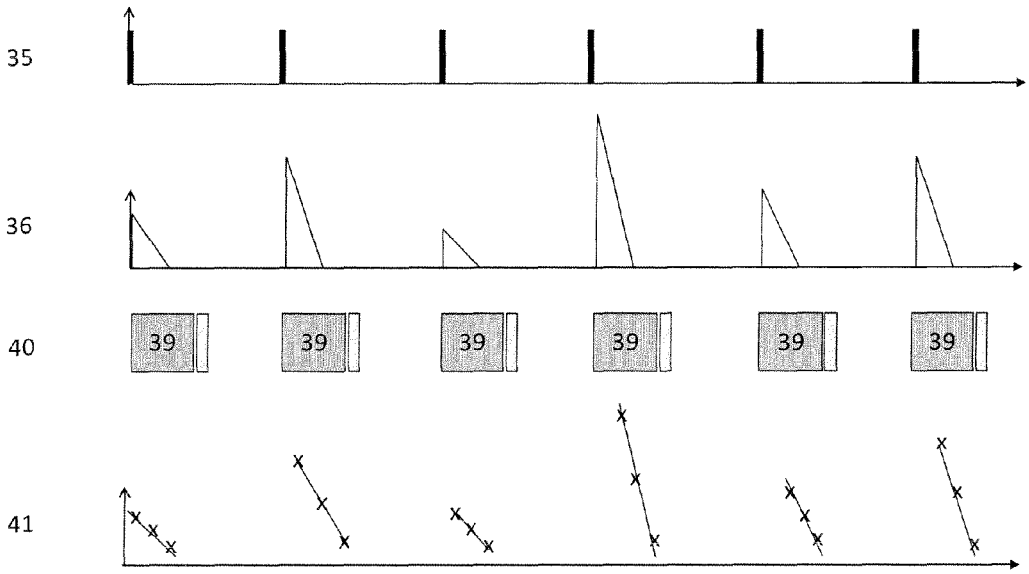
Fig. 12 Prior Art
FIG. 12 discontinuous waveform averaging with the synchronization of DAQ acquisition to an external trigger, e.g. an ionization laser that is synchronized with the periodic changing of sample.
Figure 13:
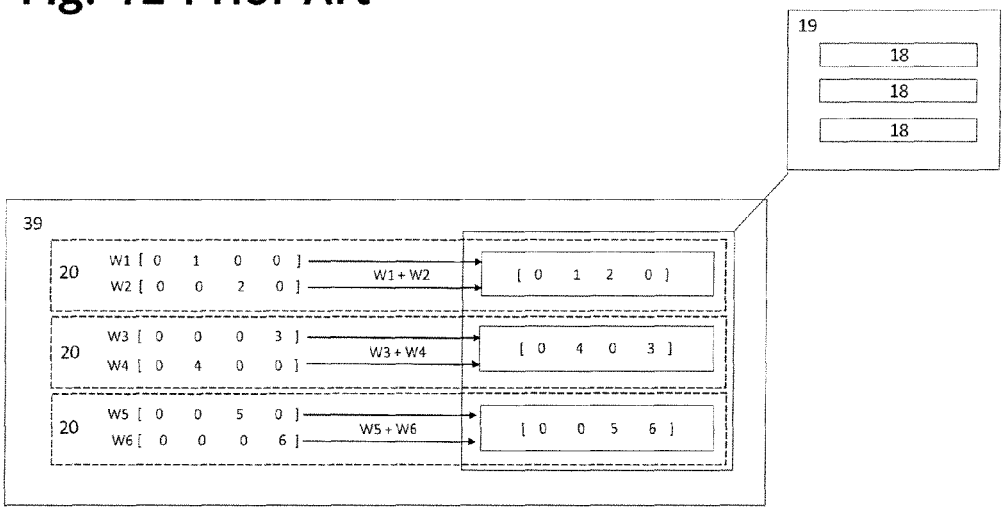
Fig. 13 Prior Art
FIG. 13 block averaging with waveform averaging, 3 segments, number of waveforms per segment: 2.
Figure 14:
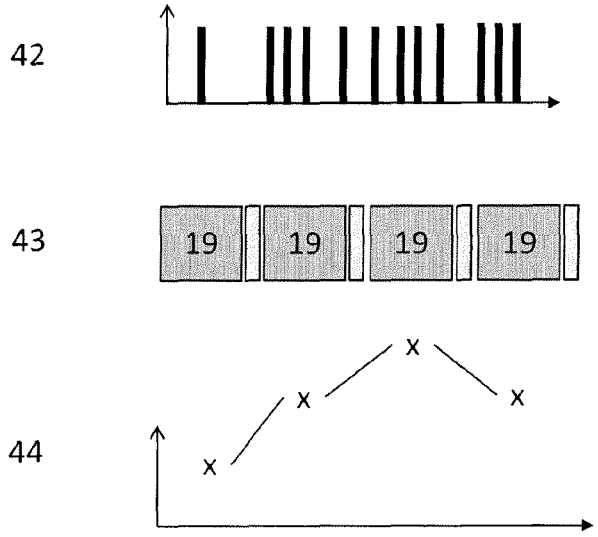
Fig. 14 Prior Art
FIG. 14 Individual events with high rate of occurrence not resolved, continuous acquisition using waveform averaging below the MCSR.
Figure 15:
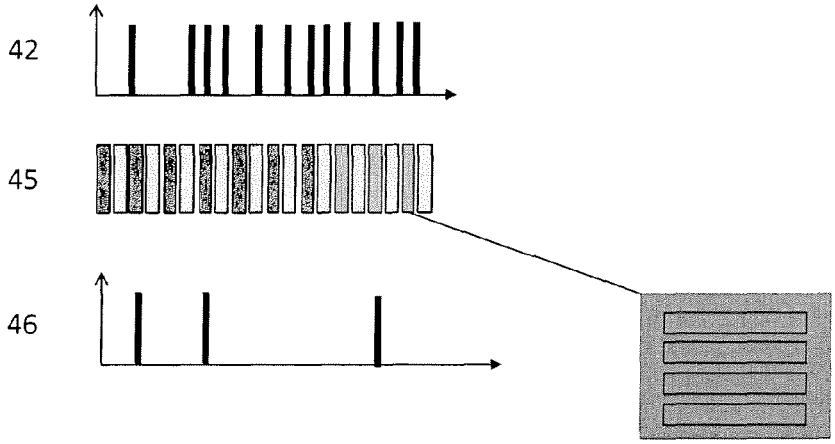
Fig. 15 Prior Art
FIG. 15 the acquisition of the signal from FIG. 14 with continuous block averaging, Individual events with a high rate of occurrence resolved but low save efficiency because of idle time.
Figure 16:
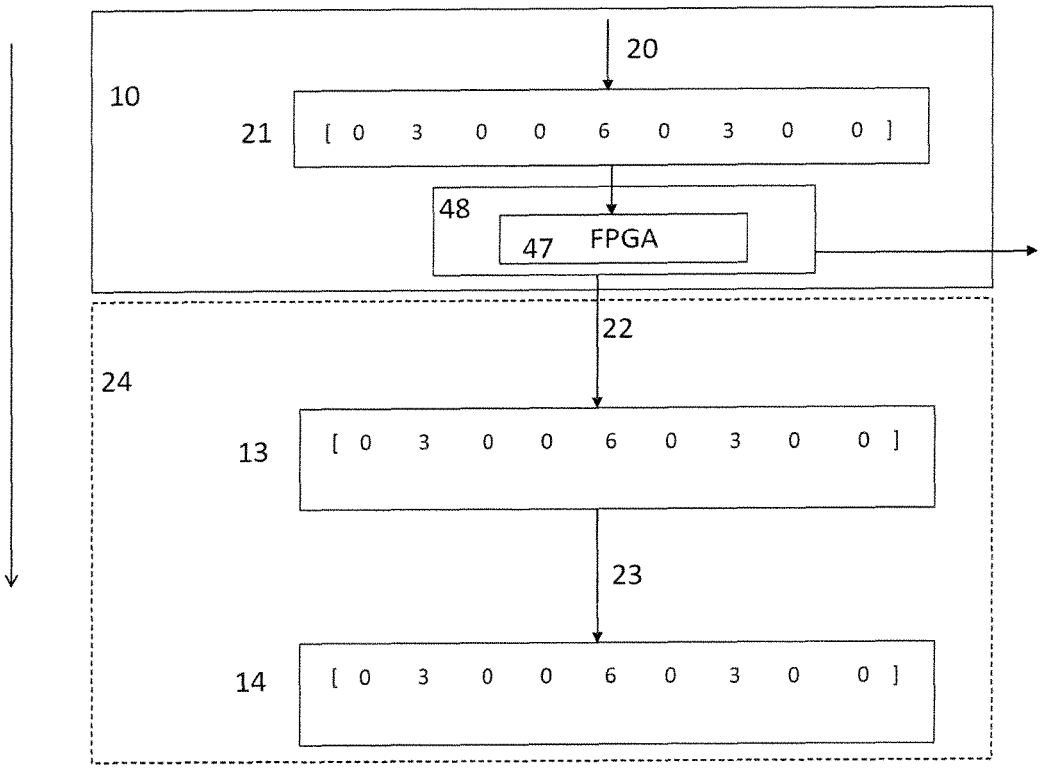
FIG. 16 Event Trigger: waveforms are averaged in digitizer memory, filtered for determination of events, and transferred to the PC only if an event is determined.

The FIG. 16 is a schematic representation of an inventive method ("Event triggering"): Waveforms are obtained from a digitizer memory, filtered for the determination of events, and transferred to the PC only if an event is determined.

The corresponding device comprises a time-of-flight (TOF) mass analyzer with a data acquisition (DAQ) system 15 that includes an analog-to-digital converter (ADC) 10 coupled to a field-programmable gate array (FPGA) 47.

The ADC continuously acquires data for every TOF extraction. As shown in the Figure, corresponding segments 21 are processed by the FPGA 47 before potential transfer to the PC. Data from segments that do not contain events of interest (EOIs) can be immediately discarded by the DAQ, thereby avoiding unnecessary overhead processes (averaging in DAQ memory, transfer to PC, processing in PC RAM, save to PC disk, etc) that may bottleneck data save rates or waste PC processing power. Further, the total amount of data saved to disk is minimized by saving only those portions of the data stream that are of interest to the experimenter.

The FPGA looks for specific, user-defined data features to determine EOIs. This FPGA processing steps is called filtering (step 48), and the user-defined criteria that are applied are called a filter.

In a first embodiment, data waveforms of successive spectra are not averaged. A memory segment 21 containing data corresponding to a single extraction is passed to the FPGA 47 which determines whether the segment contains an event of interest (EOI).

Another embodiment works like above, but a defined number of waveforms are accumulated (accumulation 20) into a single segment 21 in the FPGA before application of the ROI criteria and EOI filter, thereby increasing the number of ions available for the determination of the event. This results in more robust and reliable classification, while the time resolution (spectra/sec) of the method is reduced. FIG. 16 summarizing both this embodiment and the previous embodiment; we note that the previous embodiment is a just a special form of this embodiment in which waveform averaging is used with 1 waveform per segment.

Figure 17:
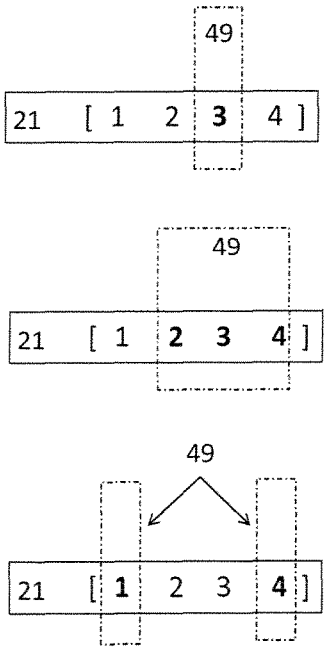
FIG. 17 a 4-sample waveform, with different regions of interest (ROI) selected: single sample, 3 adjacent samples, 2 non-adjacent samples.

An EOI is identified by analyzing data within pre-defined ranges of interest (ROI) 49 within every incoming segment. Each user-defined ROI is a subset of m/Q within the total m/Q range of the segment. In some embodiments, each ROI is a continuous subset of m/Q. In other embodiments, each ROI can be a discontinuous subset of m/Q. The FIG. 17 shows some examples, namely a 4-sample waveform, with different regions of interest (ROI) selected: single sample, 3 adjacent samples, 2 non-adjacent samples.

ROIs can be as narrow as a single data point or as wide as the entire TOF spectrum (entire mass range). The data values within an ROI represent the signal generated by all ions of one or several m/Q. It is therefore possible to evaluate the approximate number of ions detected within an ROI.

Figure 18:
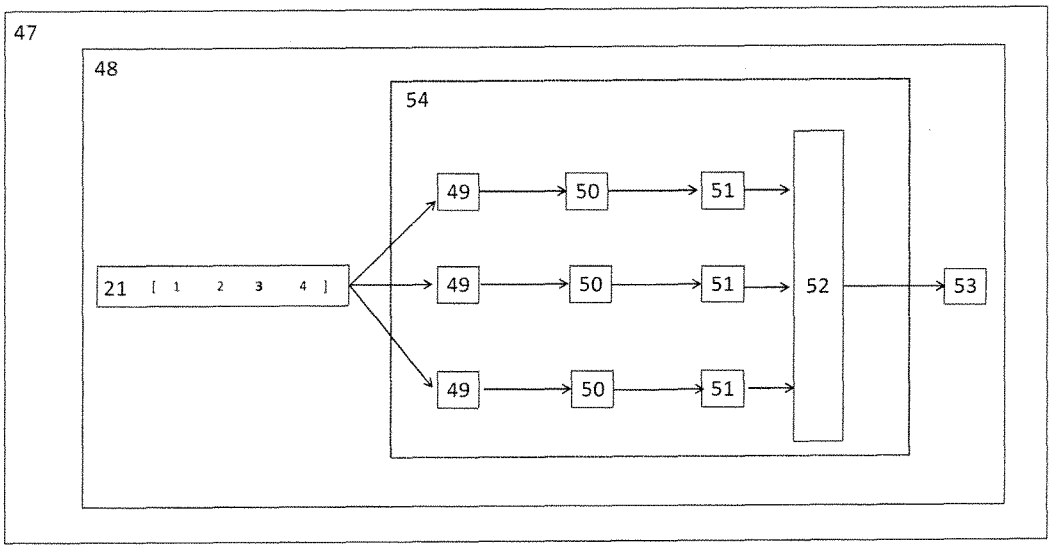
FIG. 18 a schematic depiction of an EOI filtering mechanism with three ROI; each ROI from the segment being processed is determined to meet its criterion or criteria; the results of the various ROI are logically combined to produce a EOI result.

For each ROI 49, the user also defines some logical ROI criterion 50 to be applied to the set of data points. For each ROI in each segment, the FPGA determines whether the applied ROI criterion is true or false. The determination is the ROI result 51. This is schematically depicted in FIG. 18 showing an EOI filtering mechanism with three ROI 49, each ROI 49 from the segment 21 being processed is determined to meet its criterion 50 or criteria; the ROI results 51 of the various ROI 49 are logically combined to produce a EOI result 52, finally leading to the segment's EOI Result 53.

The scope of potential ROI criteria is enormous, and could include:

- Comparison of the summed signal intensity in the ROI to some user-defined threshold values. For instance, the ROI result is true if the segment's total signal within the ROI is greater than (or less than) 1 ion.
- Temporal behavior of the ROI across segments.
  - For instance, the FPGA could maintain a running average and standard deviation of the signal in a given ROI. An ROI criterion could then be defined based on comparison to these statistical metrics.
  - For instance, an ROI criterion could be defined based on comparison of the total signal in ROI in a segment to the total signal in that ROI in a discrete preceding or following segment. For instance, segment n could be compared to segment n−1 or segment n+1.
- Comparisons of the temporal behavior of the ROI to the temporal behavior of other ROIs across multiple segments.
  - For example an event signal where the ROI of interest increases a certain time before another ROI increases. Such a signature could indicate a particle that was desorbed and ionized in a plasma having a coating and a core with different chemical composition. Or a sudden drop of intensity within a ROI can indicate a nucleation event.
- Determination of whether a spectrum is a non-event. Such logic is particularly useful in cases where the experimenter is trying to capture a wide assortment of event types, some of which may have unknown mass spectral characteristics. In this case, the experimenter may, for example, test whether the ROI in the segment is statistically different from the same ROI as measured or approximated for instrument background, which is the signal collected when no events are present.

An EOI is determined to exist within a given segment based on logical comparison (OR, XOR, AND, NOT) of all ROI results 52. We call the collection of ROIs and the logical comparison of the ROI results the EOI filter 54. The EOI filter 54 is defined by the user.

We refer to the result of the comparison as a segment's EOI Result 53. The EOI result is either positive or negative. Any segment with a positive EOI result is considered to be an EOI.

Figure 19:
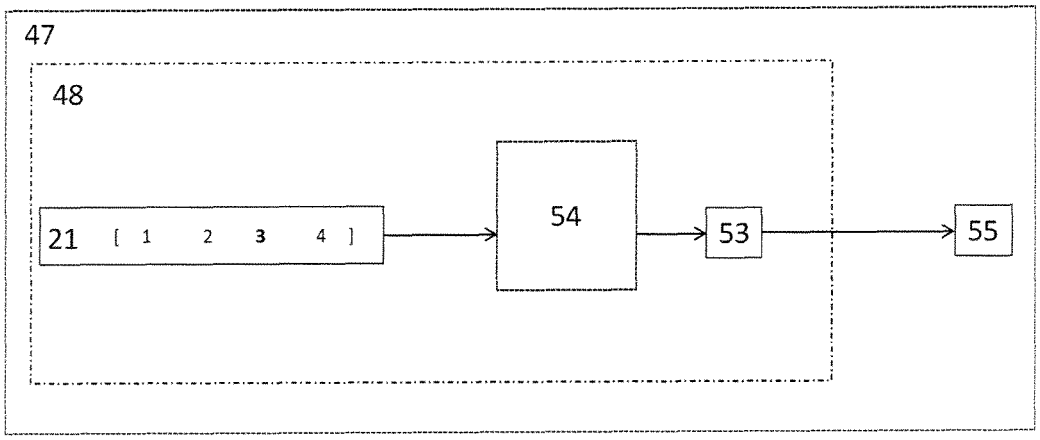
FIG. 19 additional processing in FPGA based ROI results and/or EOI result.

The FIG. 19 summarizes the EOI filtering algorithm. In the simplest embodiment, all data relating to segments with a positive EOI are transferred from the DAQ memory to the PC for possible processing and save. Prior to the transfer, the data relating to the segment may be further processed in the FPGA 47 (step 55). This is schematically shown in FIG. 19.

Figure 20:
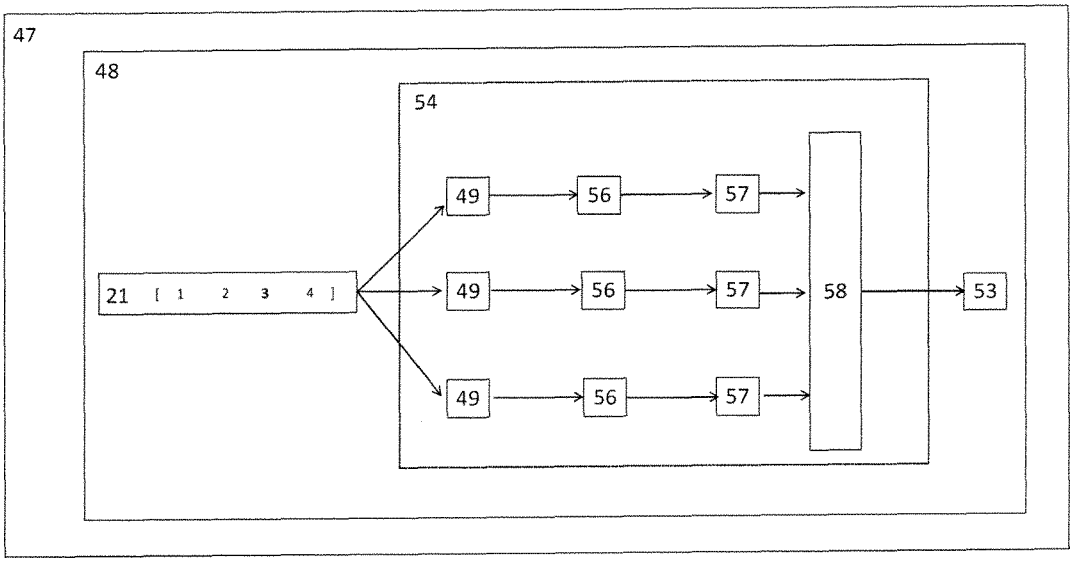
FIG. 20 a schematic depiction of the EOI filtering mechanism with three ROI and employing numeric and logical ROI and EOI functions.

Another embodiment, which is depicted in FIG. 20, works like above, but ROI results can be numeric in addition to logical (boolean, true/false). In this case, we refer to the ROI criteria as ROI functions 56, which output numerical or Boolean ROI results 57. These numerical and/or Boolean results are then combined in an EOI function 58 to determine the EOI result 53. ROI and EOI functions can include mathematical operators in addition to logical operators.

In one such embodiment, an EOI filter could be based on the mean value of 3 ROIs. In this case, each ROI result would be the total signal for the ROI. In another such embodiment, an EOI filter could compare the total signal of multiple ROIs. One of those ROIs could be all data points in the segment ("total ion signal).

In some such embodiments, some ROI results are Boolean while others are numeric.

Figure 21:
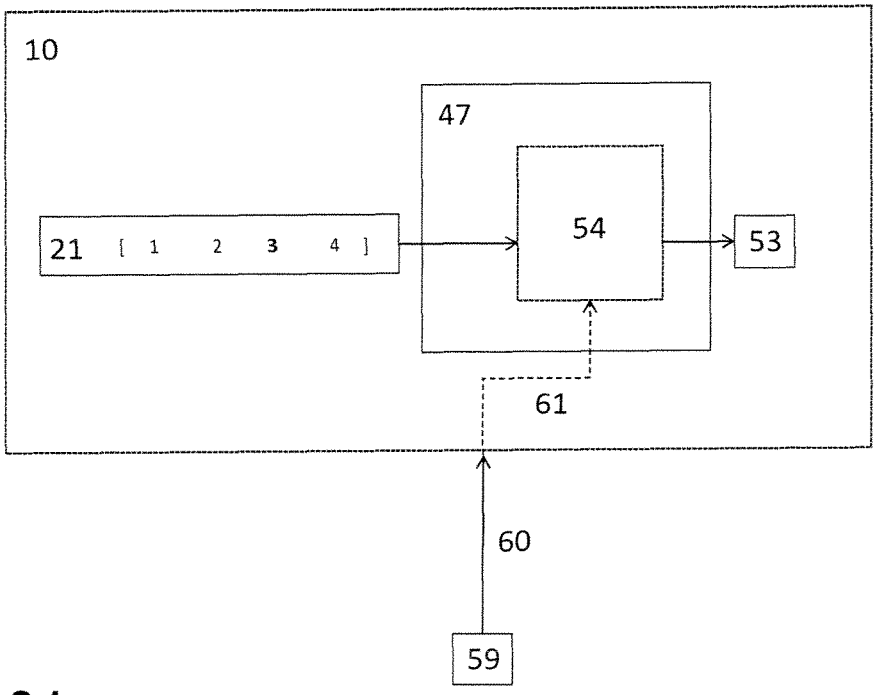
FIG. 21 the incorporation of external data for synchronized recording with events and/or inclusion in EOI filtering.

A further embodiment described in connection with FIG. 21 works like above, except that for each event, some externally input or measured value 59 is provided (transfer 60) to the DAQ 10 or FGPA 47 in order to know the state of that value at the instant the event occurred. This allows for synchronized recording of external data with events and/or including external data in EU filtering.

Correspondingly, a further embodiment works like above, but externally input data value(s) are incorporated (step 61) into ROI criteria or functions or EOI criteria or functions.

Figure 22:
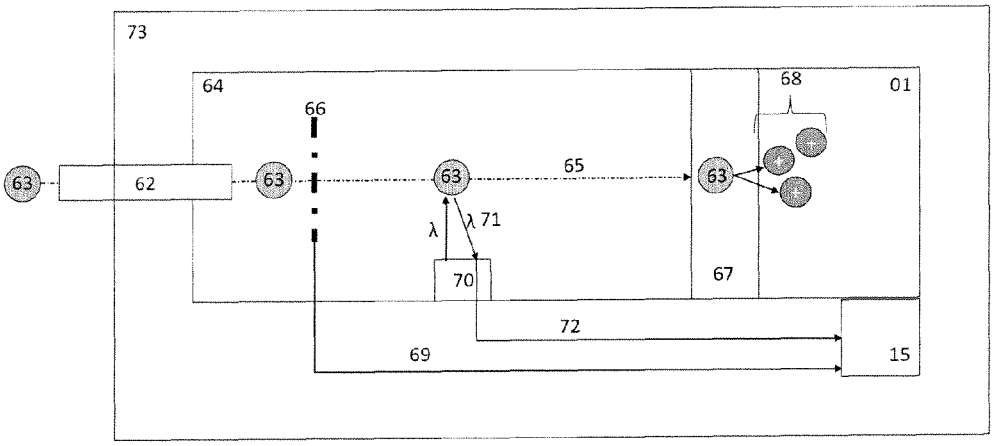
FIG. 22 an example of an aerosol mass spectrometer with TOF analyzer and including both aerosol gating and light scattering devices.

For instance, as shown in FIG. 22 in some aerosol mass spectrometers 73 a light scattering device 70 is installed in the particle drift region 64 ahead of the mass spectrometer. Aerosols 63 are introduced into the vacuum chamber through an orifice 62 and drift along trajectory 65. Those aerosols 63 being larger than a minimum diameter that pass through the inlet generate one or more light scattering signals 71. This data indicates that a particle has entered the instrument, and—depending on configuration—may provide insight into the aerosol's composition, size or shape. If these data (signal 72) are provided to the FPGA (within DAQ 15) before the arrival of the particle in the TOFMS, an ROI criterion could be defined such that segments with ion signals below the anticipated number of ions—based on aerosol size—have a false ROI result.

Figure 23:
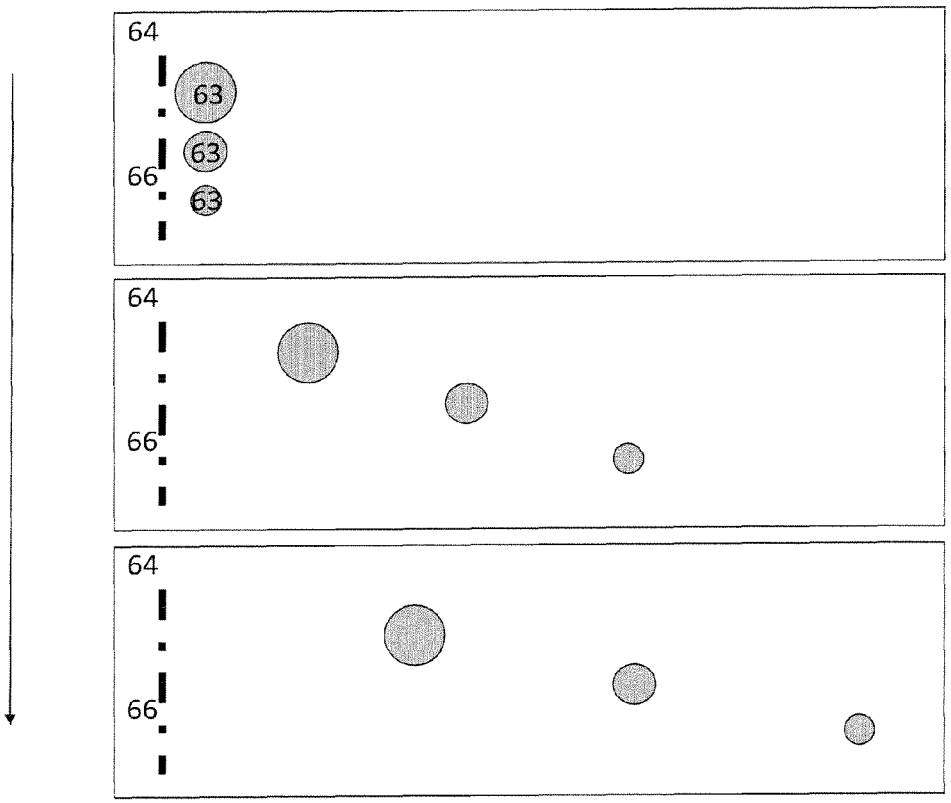
FIG. 23 a schematic representation of particle-size separation based on drift velocity.
Figure 24:
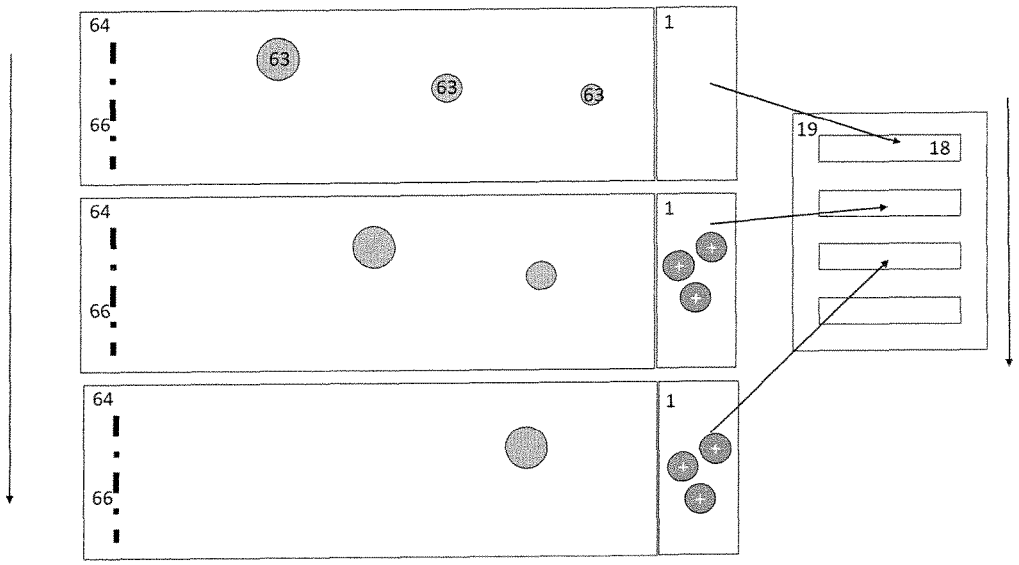
FIG. 24 a further schematic representation of particle-size separation based on drift velocity.

In some aerosol mass spectrometers, transmission of aerosols 63 is mechanically modulated by the modulation device 66 upstream of the mass analyzer. In particular, aerosols are sampled into the instrument in short bursts. As shown in FIG. 23, aerosols within this burst will separate based on size as they drift toward the mass analyzer, with small particles drifting faster than large particles. The modulation enables the measurement of transmitted particles' drift time between the modulation device 66 and the vaporization and ionization device 67 that time can be used to calculate aerosol size. As shown in FIG. 24, if the particle beam is modulated, the sequential segments 18 of the DAQ memory 19 correspond to increasingly larger aerosols. If a trigger is input to the FPGA simultaneous to the opening of the modulation device (signal 69), the FPGA can calculate the size of particles being recorded during any segment in the continuous segment data stream.

The timestamp of the most recent input trigger corresponding to the particle modulation can be saved with the event for determination of particle size in post processing (embodiment=Event Trigger with ROI criteria that consider external data or trigger) or, as an example of the current embodiment, an ROI criterion could be defined such that segments with ion signals below the anticipated number of ions—based on particle size—have a false ROI result.

A further embodiment works like the above, but certain segments within the continuous stream of data segments are excluded (EOI filtering not applied) based on an external measurement.

For instance, in some aerosol mass spectrometers 73 that incorporate light scattering devices 70, the light scattering data (signals 72) can be used to estimate when the aerosol will arrive at the mass analyzer 68. Event triggering can thus be run in a mode where it only analyzes segments occurring within the estimated range of TOF particle detection times. Segments outside of this range are assigned a negative EOI result without EOI filtering.

As another example, in aerosol mass spectrometers that determine aerosol size based on mechanical modulation of the aerosol beam, there is some minimum drift time required for the smallest particles to reach the mass spectrometer. Segments recorded before this drift time has elapsed, contain data for the background or the gas that entered the system with the aerosols. See, for example, FIG. 24 where the first segment 18 corresponds to a time before the MS measurement of the smallest particle. If a trigger (signal 69) is input to the FPGA simultaneous to the opening of the modulation device, the FPGA can calculate the size of particles being recorded during any segment 18 in the continuous segment data stream. Based on this calculation it can exclude segments that do not represent reasonable particle drift times (e.g., too short of delay) or segments that fall outside of the size range of interest.

By incorporating external measurements, this embodiment enables the use of broader filters (capture more events) while reducing the risk of false positives.

This embodiment can be combined with Event Trigger with ROI criteria that consider external data to further reduce the likelihood of false positives.

A further embodiment works like above, but an ROI criterion can be based on comparison of recorded data to some reference mass spectrum or spectra. These mass spectra may be input by the user, or reference mass spectra may be recorded and stored in the memory of the FPGA. Reference spectra may represent anything, including background or events of interest.

A further embodiment works like above, but the user may choose to globally ignore specific data points within all waveforms in the application of all ROI criteria. This may have utility, for example, in situations where large background signals are consistently recorded at specific m/Q values, such that those m/Q values have no utility in the determination of events. It may also have utility in cases where the FPGA allows a finite number of ROI. In this case, for example, the user may wish to define the m/Q range 1 to 100 Th, excluding 28 Th. In the absence of the zeroing enabled by this embodiment, this exclusion requires 2 ROIs: 1 to 27 Th and 29 to 100 Th.

A further embodiment works like above, but the FPGA subtracts pre-defined values from the data values of the waveform before EOI filtering. For instance, most mass spectrometers have background signal, which is the signal measured when no event is occurring. EOI filtering may be enhanced if the equivalent background signal for some or all data points in the segment is subtracted from the data points in each or some of the ROIs. That equivalent background signal may be input by the user or a reference spectrum may be recorded and stored before EOI filtering.

A further embodiment works like above, but in the evaluation of segment n the EOI filter is applied to an average segment that is calculated by the FPGA as the average over some window of successive segments from segment n−x to segment n+y, where x and y are adjustable. This allows for the detection of small or slow events that could not be detected in a single segment (e.g. due to low signal to noise ratio).

A further embodiment works like above, but an event can extend across multiple segments based on unique criteria for start and end segments of the event.

In the simplest embodiment an event is a series of successive segments, all of which have the same positive EOI result.

In other embodiments, unique ROI and EOI criteria are defined in order to determine the start and stop segments. These criteria may use the same or different ROI than are used for determination of the event.

A further embodiment works like above, but the start and end segments are a fixed number of segments before (start) and after (end) the segment having a positive EOI result. In this embodiment, each event can said to be represented by a block of fixed number of segments.

Figure 25:
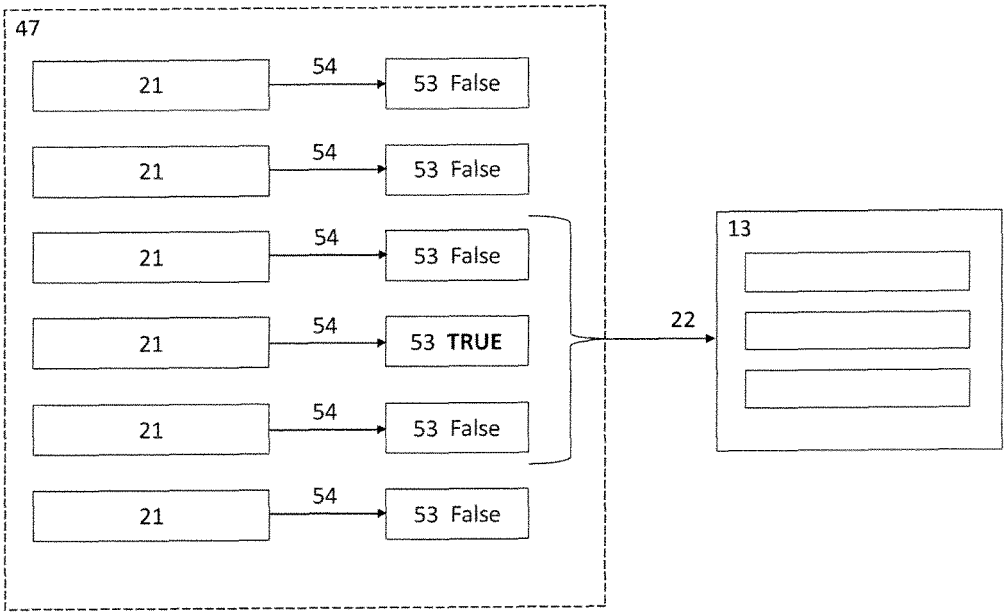
FIG. 25 Event Triggering with pre- and post-segments both equal 1 segment; the identified event includes 1 segment before and 1 segment after the segment that has a positive EOI result.
Figure 26:
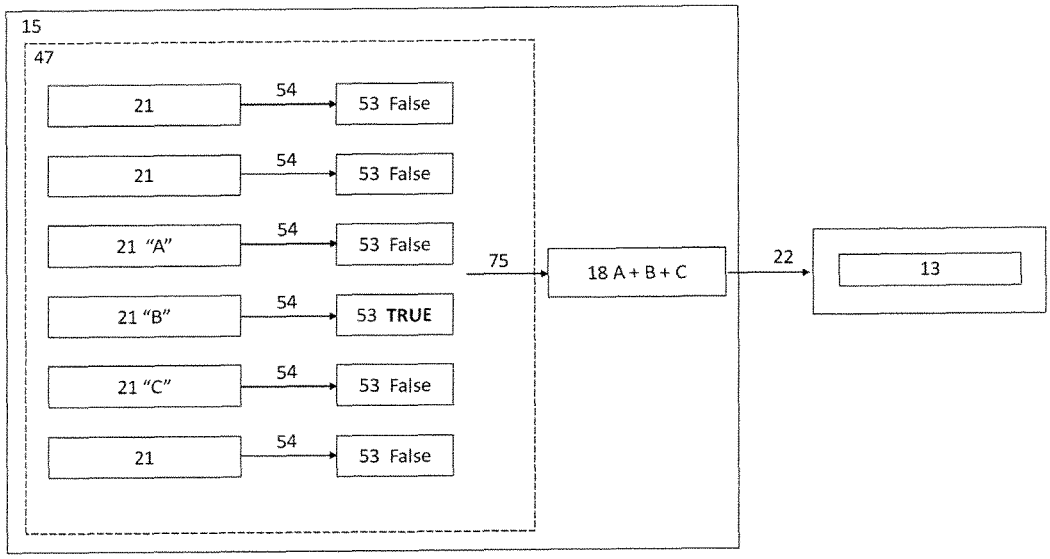
FIG. 26 Event Triggering with pre- and post-segments both equal 1 segment and with averaging (summing) of all event segments before save to disk; the identified event includes 1 segment before and 1 segment after the segment that has a positive EOI result; in this case, these three segments are summed before data are transferred to the PC; averaging could also be done in PC RAM before save to disk.

The FIG. 25 demonstrates the case where events include 1 pre- and 1 post-segment. The FIG. 26 demonstrates the case with pre- and post-segments both equal 1 segment and with averaging (summing) of all event segments before saving to disk. The identified event includes 1 segment before and 1 segment after the segment that has a positive EOI result; in this case, these three segments are summed before data are transferred to the PC; averaging could also be done in PC RAM before saving to disk.

A further embodiment works like above, but after determination of the event by the FPGA the segments belonging to an event are accumulated (accumulation step 75) into a single waveform, thereby reducing the data load. This segment averaging can be performed in the FPGA or after download in the PC.

A further embodiment works like above. Additionally, the data for all events are averaged (averaging step 76) into a single segment or block by the FPGA or the PC. For events consisting of more than 1 segment, all segments for all events may be averaged into a single waveform (waveform averaged), or the final averaged data may contain multiple segments (block), each an average of the corresponding segments for each event.

Figure 27:
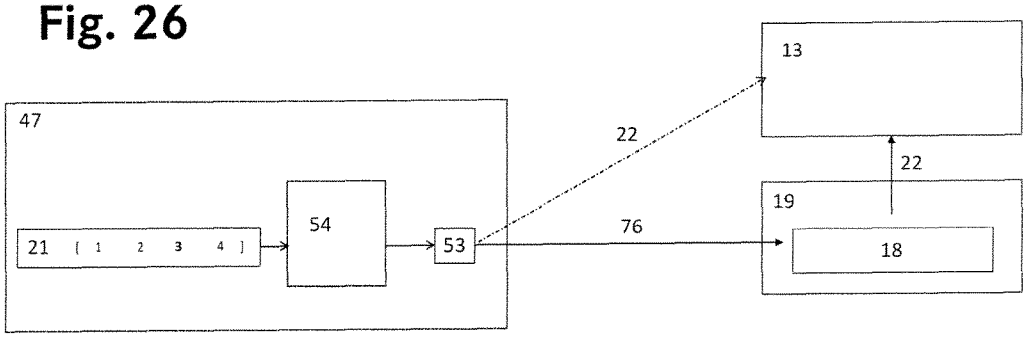
FIG. 27 averaging of events in FPGA; in contrast to the simpler embodiments where data for all events are transferred to the PC, Individual events are averaged in the memory of the DAQ; transfer of data for individual events is then optional.

In contrast to the simpler embodiments where data for all events are transferred to the PC, Individual events may be averaged in the memory of the DAQ, the transfer of data for individual events (step 22) to PC RAM is then optional, cf. FIG. 27.

If individual events are not downloaded to PC, this method has the disadvantage of giving up information about specific events but—relative to conventional waveform averaging or block averaging—it increases signal to noise (sensitivity) by rejecting data segments that contain only noise.

A specific example of the signal-to-noise advantage enabled by the embodiment "Event Trigger with event accumulation" can be found by combining that embodiment with the embodiment "Event trigger with synchronization to external data."

Aerosol mass spectrometers that determine particle size by mechanical modulation of the aerosol beam often operate in a block averaging mode, where each opening of the inlet serves as a block trigger after which an n-segment block of data are acquired. A fixed number of blocks are recorded and accumulated to give an average 2D data set, representing the mass spectra (segments) as a function of size (segment number) of the total aerosol population.

For normal aerosol concentrations, many of the recorded blocks will not contain aerosols data; that is, aerosol concentrations are low, such that aerosol do not enter the mass spectrometer every time the inlet is open. Data recorded in these blocks (inlet openings) only contribute noise (background or gas-phase ion signals) to the average.

Figure 28:
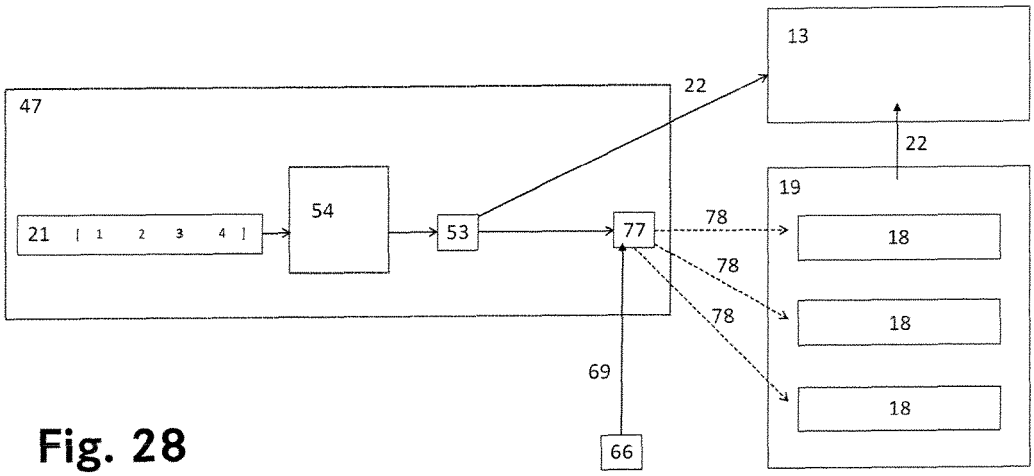
FIG. 28 size-resolved TOFMS of particles with noise rejection by Event Triggering; the time of occurrence of each event is determined relative to an external trigger, and data for the event are averaged in a specific DAQ memory segment based on this time of occurrence.

In order to construct a sized-resolved data block containing data from only those periods of time during which particles were measured, one can use event trigger mode while inputting a trigger corresponding to the opening of the modulating device 69 (see FIG. 28). The FPGA records a timestamp of each trigger in order to know when the inlet was last open. For each event, the FPGA reports a timestamp that can be compared (step 77) to the timestamp of the last input trigger in order to determine the delay between the last trigger (inlet opening) and the event. An averaged 2D dataset (particle size vs MS) is then reconstructed in the FPGA or PC memory by summing the mass spectra of all events, each offset in the particle size dimension according to the size determined from the offset between the trigger and the event.

Individual events can optionally be downloaded simultaneous to the averaging in the DAQ memory 19 (step 78).

Figure 29:
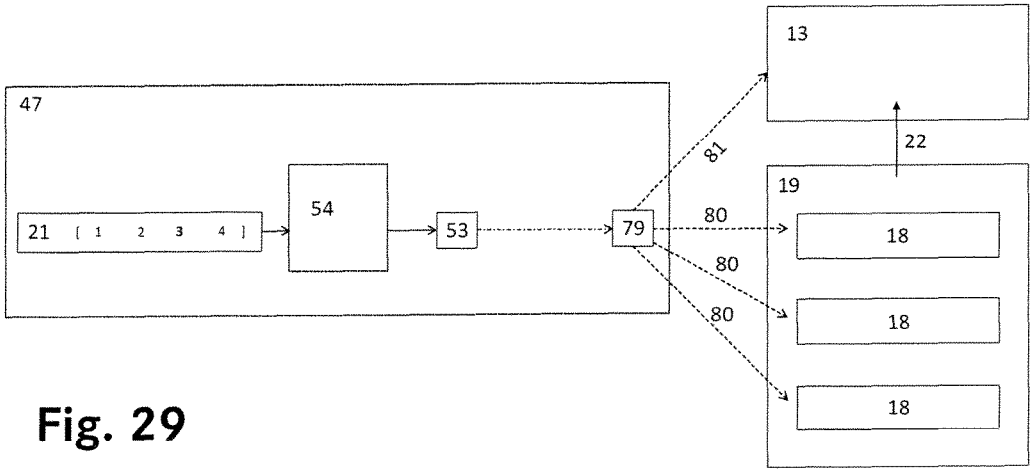
FIG. 29 the classification of events by FPGA with (optional) class specific averaging and selective download of events to PC RAM based on classification.

Another embodiment is the same as above, but classification schemes 79 can be applied to segments with positive EOI results. These schemes are applied by the FPGA and sort positive EOIs (events) into several classes. Subsequent data handling and averaging in the FPGA or the PC can then include functions that are classification specific. This is shown in FIG. 29. For example, the event accumulation can be made class specific (step 80). Events of some classes may be accumulated, whereas events of another class are downloaded as single events 81, whereas events of other classes may be rejected. The classification can be reported with the mass spectral data. Also, only the classification of the events could be reported which is the same as saying that all the spectra evaluation of an event is done on board of the DAQ electronics.

In the context of a specific embodiment of "Event trigger with event classification" events are classified (classification step 79) based on the total amount of signal present in the ROIs. Some small events, for example very small particles, will present very few ions to the mass spectrometer. In the worst case only one ion may be recorded for an event. The single event mass spectrum of such events is not very useful, but the accumulated spectrum of many events may be useful. Therefore one strategy to reduce data load is to save specific data corresponding to, e.g. an event that deliver fewer ions than a predefined threshold. Instead, the spectra from these low-intensity events may be accumulated (accumulation step 80) by the FPGA or PC RAM. In this embodiment, the option exists to transfer (step 81) and save non-accumulated data for each large event. Preferably, large events are not accumulated with the small events, as they would dominate the average spectrum. Rather, events may be accumulated in classifications based on signal level (for example, next embodiment), or only low signal events would be accumulated. An exception, related to aerosol mass spectrometry, is when large particles are separated in a time dimension from the small particles. In this case they can be accumulated in separate segments of a block in a block averaging.

The averaging of small events described above could be done in several average segments. For example, all events producing only one ion could be averaged into Segment 1, all events producing two ions would be averaged in Segment 2, and so on. For the case of aerosol mass spectrometry, this would result in size dependent averaging thereby avoiding that large particles producing many ions would swamp the signals of small particles.

Processing of events, which is all steps performed in the FPGA or PC RAM following the initial EOI filtering, can be enhanced by incorporating external data relevant to positive events. For instance, in some aerosol mass spectrometers a light scattering device is installed in the inlet of the mass spectrometer. Aerosols larger than a minimum diameter that pass through the inlet generate a light scattering signal. This data indicates that a particle has entered the mass spectrometer, and may provide insight into the aerosol's composition, size or shape. If these data are provided to the FPGA before the arrival of the particle in the mass spectrometer, events could be classified based on the intensity of the preceding light scattering event.

In another embodiment, data from external signals is incorporated in the processing. In some aerosol mass spectrometers the particle inlet is modulated (open/closed) and particle time of flight between the inlet and the mass spectrometer is measured in order to determine particle size. For such a system using event triggering, one can determine a time of flight for each event; this is calculated as the time difference between a segment having a positive EOI result and the last opening of the particle inlet. This event time of flight can be saved with the event. It can also be used by the FPGA to further filter or characterize recorded events.

In one such embodiment, it could be used as the metric for the above embodiment "Event Trigger logic with classification."

In one such embodiment, it could be used as the metric for the above embodiment "size dependent small particle accumulation."

In one such embodiment, the system would reject all events having a time difference relative to the chopper trigger which is too short to represent a real particle time of flight.

A further embodiment works like above, except the experiment aims to determine information other than the complete mass spectrum.

Figure 30:
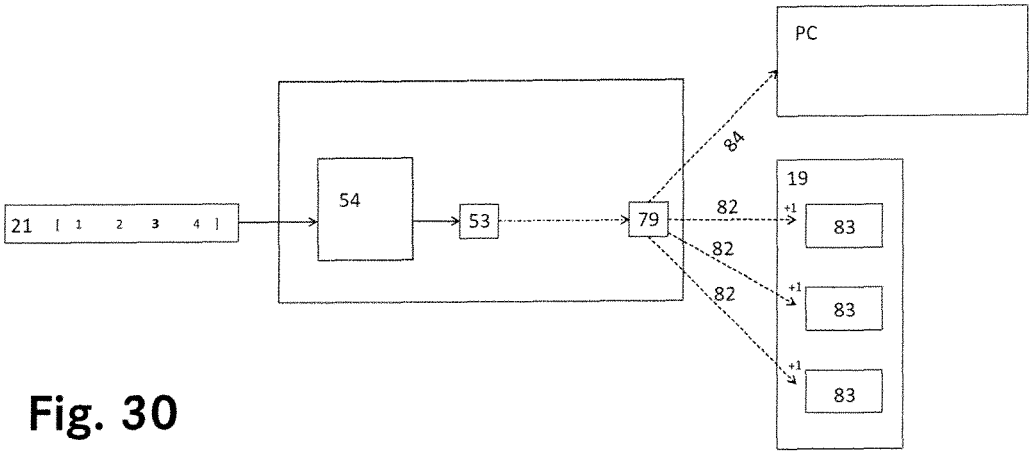
FIG. 30 the accumulation and transfer of partial mass spectra or non-spectral information based on classification.

For instance, without classification of events after filtering, the FPGA/DAQ may count (step 82) the total number 83 of events. This total number 83 of events is held in DAQ memory 19 and later downloaded. With classification of events, the DAQ may have increment and save specific counter values for each time of classified event (see FIG. 30).

Simultaneous to such counting, or in place of such counting, the DAQ may transfer (step 84) the classification result and/or some portion (limited number of data points) of the mass spectrum to the PC. The data points transferred may depend on the classification of the event.

Transferring only the classification result or only select portions of the spectrum greatly reduces the data load and increases the maximum rate at which event triggering data can be saved.

This invention has utility for fast mass spectrometer based measurements of discontinuous events, which is any experiment where the signal of interest is fluctuating between "on" and "off" states across the duration of the measurement.

Discontinuous events can be observed because the experiment is measuring many different samples, which are presented to the mass spectrometer in succession with some finite time between each.

This discontinuity may be a feature of the ionization scheme. Examples include temporally short ionization methods like ionization by laser pulses, by flash light, by break downs.

The discontinuity may be a feature of the sampling scheme or some other analytical process upstream of the mass spectrometer. Examples include fast separation methods like ion mobility separation (IMS), and chromatography.

This discontinuity may reflect the finite nature of the successive samples: Examples include the analysis or classification of particles (like nano particles, aerosol particles, cells, viruses, droplets), localized areas (pixels) on surfaces, localized volumes (voxels) in solids, interfaces on solids or surfaces.

A specific example of the analysis of sporadic, finite samples is the analysis of particles by inductively coupled plasma (ICP) TOFMS. These particles are delivered either in droplets or in a gas stream. In the latter case, the gas has to be exchanged for the plasma gas (usually Ar). Then the continuous flow of gas containing the particles is sampled into continuous plasma, producing ions from all molecules (plasma gas and particles) present in the continuous gas flow. The experimenter may be interested in isolating those ion signals associated with specific particles ("single particle analysis"). But, because of the sporadic nature of the particle detection events, high efficiency single particle analysis would not be possible with traditional DAQ systems. Use of event trigging uniquely enables the recording of complete ICP-TOF mass spectra of individual particles with high efficiency.

A similar example of the analysis of sporadic, finite samples is the analysis of aerosol particles that may contain traces of hazardous or banned materials, or chemical compounds indicative of such materials, including explosives, drugs, poisons, chemical warfare agents, or bio-warfare agents. In such cases, the compounds of interest may exist as part of a human-generated particle or exist as residue on an ambient particle (including dust and skin particles). Concentration of these particles may be very low and/or the concentration of materials of interest within these particles may be very low. When continuously acquiring TOFMS data in order to detect such particles in air, it will likely be the case that the majority of TOF extractions will not contain signals of interest. But, all extractions will contain many signals corresponding to the complex mixture of compounds found in ambient air. Therefore, if sampling air and averaging TOF extractions by standard methods, the signals of interest may not be discernible within the mass spectrum of the total air sample. But, the concentration of these compounds of interest will spike at the moment particles of interest are sampled into the mass spectrometer. In this case, these compounds may be detected by applying event trigger and keeping only those data segments (mass spectra) that contain potential signals of interest. Data segments corresponding to individual particles can be downloaded to the PC for further processing and/or data from many individual particles can be averaged if on-board classification is sufficiently specific. In this way, event triggering lowers the absolute limit of detection of the TOFMS for these compounds. For these applications, electron ionization (EI) or chemical ionization (CI) is preferred as these methods allow for compact and cost-efficient devices. Alternatively, ionization at atmospheric pressure is also possible, but will usually require slightly more complicated mass spectrometers.

Discontinuous events can be observed because the experiment is measuring a single sample or volume of gas, for which the ions of interest have rapidly changing concentrations.

Examples include real-time sampling of atmospheric gases or the analysis of human breath.

Different advantages can be achieved depending on application and objectives:

1. For cases where the experiment attempts to resolve rapid changes in the sample or fast changes of sample, event triggering enables the resolution of faster changes than can be resolved with the current state of the art. In particular, rapidly changing refers to toggling of the signal at a rate comparable to the TOF extraction frequency.
2. For cases where the experimenter attempts to identify and classify a very large number of samples (events), event triggering and embodied processing methods reduce data load across the PC bus and the total amount of data saved to disk.
3. For cases where the experimenter averages the total signal of across the duration of a discontinuous sample or across many samples, achieved signal-to-noise can be enhanced be rejecting those portions of the data stream that contain only noise.

It could also occur due to imaging in exotic cases where the rastering occurs unpredictably and/or no raster trigger is available.

It is to be noted that the invention is not restricted to the described embodiments. In particular, a variety of different combinations of filter criteria and ROI is possible. Basically, they may be chosen by the user to best fit his or her requirements in the context of a given analysis.

The invention claimed is:

1. A device for mass spectrometry comprising:

a) an ionization source;

b) a mass analyzer fluidly coupled to the ionization source;

c) an electronic data acquisition system for processing signals provided by the mass analyzer;

whereas the electronic data acquisition system comprises d) at least one analog-to-digital converter producing digitized data from the signals obtained from the mass analyzer;

e) a fast processing unit receiving the digitized data from said analog-to-digital converter;

wherein f) the fast processing unit is programmed to continuously, in real time inspect the digitized data for events of interest measured by the mass spectrometer, wherein said inspection is based on a filter definition, the filter definition comprising at least one region of interest including a selection of values of m/Q and further comprising at least one filter criterion to be applied to the at least one region of interest, wherein the selection of values of m/Q is a subsection of all values of m/Q of an entire mass spectrum; and g) the electronic data acquisition system is programmed to forward the digitized data representing mass spectra relating to events of interest for further analysis and to reject the digitized data representing mass spectra not relating to events of interest.

2. The device as recited in claim 1, wherein the analog-to-digital converter comprises a buffer memory for storing a number of data segments, each segment representing a mass spectrum, wherein data segments representing mass spectra relating to events of interest are forwarded for further analysis and data segments representing mass spectra not relating to events of interest are rejected.

3. The device as recited in claim 2, wherein the analog-to-digital converter is programmed to average the digitized data representing a plurality of mass spectra and to store the resulting averaged data in the buffer memory.

4. The device as recited in claim 1, wherein the filter definition comprises a plurality of regions of interest and wherein an event of interest is identified by application of the at least one filter criterion to the plurality of regions of interest, results of the application to different regions of interest being logically combined.

5. The device as recited in claim 1, wherein the filter definition comprises a plurality of filter criteria and wherein an event of interest is identified by application of the plurality of filter criteria to the at least one region of interest, results of the application of different filter criteria being logically combined.

6. The device as recited in claim 1, wherein said processing unit computes for each of said at least one region of interest at least one value that correlates to or encodes a total ion signal in said region.

7. The device as recited in claim 1, further comprising an averaging module for receiving the mass spectra relating to events of interest and for averaging the received mass spectra prior to further analysis.

8. The device as recited in claim 1, further comprising a classifier module for classifying identified events according to classification criteria, wherein results obtained from classification are transferable along with the digitized data representing the mass spectra relating to events of interest for further processing.

9. The device as recited in claim 8, further comprising a counting module for counting a number of events in each of a plurality of classes, wherein results obtained from counting are transferable along with the digitized data representing the mass spectra relating to events of interest for further processing.

10. The device as recited in claim 1, the electronic data acquisition system comprising an interface for receiving external data, wherein the electronic data acquisition system is programmed to forward the received external data relating to an event of interest together with the digitized data representing mass spectra relating to the event of interest and/or to include the received external data in the inspection of the digitized data for events of interest.

11. The device as recited in claim 1, wherein the electronic data acquisition system is programmed to forward digitized data representing a user-defined portion of the mass spectra relating to events of interest for further analysis.

12. The device as recited in claim 1, wherein the electronic data acquisition system comprises a first unit comprising the fast computing unit and being unitary with the mass analyzer and the device further comprises an external computing unit for further analysis, wherein only the digitized data representing mass spectra relating to events of interest is forwarded from the first unit to the external computing unit.

13. The device as recited in claim 1, further comprising a controller for controlling the operation of the ionization source and of the mass analyzer, wherein the controller receives data obtained from the inspection of the digitized data for events of interest and wherein the controller adjusts operation parameters of the ionization source or of the mass analyzer or of both the ionization source and the mass analyzer based on the received data.

14. A device for mass spectrometry comprising:

a) an ionization source;

b) a mass analyzer fluidly coupled to the ionization source;

c) an electronic data acquisition system for processing signals provided by the mass analyzer;

whereas the electronic data acquisition system comprises d) at least one analog-to-digital converter producing digitized data from the signals obtained from the mass analyzer;

e) a fast processing unit receiving the digitized data from said analog-to-digital converter;

wherein f) the fast processing unit is programmed to continuously, in real time inspect the digitized data for events of interest measured by the mass spectrometer, wherein said inspection is based on a filter definition, the filter definition comprising at least one region of interest including a selection of values of m/Q relating to m/Q values of ions from expected constituents of the analyzed sample and further comprising at least one filter criterion to be applied to the at least one region of interest, wherein the selection of values of m/Q is a subsection of all values of m/Q of an entire mass spectrum; and g) the electronic data acquisition system is programmed to forward the digitized data representing mass spectra relating to events of interest for further analysis and to reject the digitized data representing mass spectra not relating to events of interest.

15. A device for mass spectrometry comprising:

a) an ionization source;

b) a mass analyzer fluidly coupled to the ionization source;

c) an electronic data acquisition system for processing signals provided by the mass analyzer;

whereas the electronic data acquisition system comprises d) at least one analog-to-digital converter producing digitized data from the signals obtained from the mass analyzer;

e) a fast processing unit receiving the digitized data from said analog-to-digital converter;

wherein f) the fast processing unit is programmed to continuously, in real time inspect the digitized data for events of interest measured by the mass spectrometer, wherein said inspection is based on a filter definition, the filter definition comprising at least one predefined region of interest being a subset of m/Q within the total m/Q range and further comprising at least one filter criterion to be applied to the at least one region of interest; and g) the electronic data acquisition system is programmed to forward the digitized data representing mass spectra relating to events of interest for further analysis and to reject the digitized data representing mass spectra not relating to events of interest.

* * * * *